United States Patent [19]

Fujishiro

[11] Patent Number: 4,671,501

[45] Date of Patent: Jun. 9, 1987

[54] TURNING-BAR-LESS FOLDING MACHINE OF W-WIDTH ROTARY PRESS

[75] Inventor: Yuji Fujishiro, Tokyo, Japan

[73] Assignee: Kabushiki Kaisha Tokyo Kikai Seisakusho, Tokyo, Japan

[21] Appl. No.: 877,270

[22] Filed: Jun. 23, 1986

[51] Int. Cl.[4] ..... B41F 13/56

[52] U.S. Cl. ..... 270/21.1; 493/346; 270/43; 270/52

[58] Field of Search ..... 270/1.1, 4, 6, 8, 10, 270/18–19, 21.1, 43, 41, 52; 101/224, 226, 227, 232; 493/352, 353, 355–360, 345–346

[56] References Cited

U.S. PATENT DOCUMENTS

| | | | |
|---|---|---|---|
| 2,487,404 | 11/1949 | Zuckerman | 270/43 |
| 3,518,940 | 7/1970 | Stroud et al. | 101/224 X |
| 3,972,283 | 8/1976 | Jennings | 101/226 |
| 4,177,730 | 12/1979 | Schriber et al. | 101/226 |
| 4,538,517 | 9/1985 | Michalik et al. | 270/21.1 X |
| 4,587,898 | 5/1986 | Welschlau | 101/224 |
| 4,605,210 | 8/1986 | Hechler | 270/41 |

FOREIGN PATENT DOCUMENTS

| | | | |
|---|---|---|---|
| 731489 | 4/1966 | Canada | 270/18 |
| 209871 | 11/1984 | Japan | 101/226 |

*Primary Examiner*—E. H. Eickholt

*Attorney, Agent, or Firm*—Trexler, Bushnell, Giangiorgi & Blackstone, Ltd.

[57] ABSTRACT

A folding machine is composed of a mechanism for longitudinally dividing W-width travelling webs into two parts and overlaying one web on the other, the mechanism being mainly constituted by a former having the configuration of an inverted triangle with the base having a length equivalent to the W-width of a travelling web, and a slitter knife; a vertical pair of mechanisms for longitudinally folding the ½ W-width travelling webs into two parts which is mainly constituted by a pair of formers having the configuration of an inverted triangle with the base having a length equivalent to the ½ W-width of the travelling webs, the pair being veritcally disposed on the downstream side of the slitting and gathering mechanism at the same position with respect to the lateral direction of the travelling webs; a mechanism for cutting and folding the ¼ W-width travelling webs in the lateral direction thereof; and a means for combining the route for the ½ W-width travelling webs which are discharged from the upper folding mechanism with the route of those which are discharged from the lower folding mechanism. The folding machine may be further provided with one or more color printed page rearranging means. Two folding machines may be combined with each other to deal with the printing of a newspaper having a great number of pages.

11 Claims, 56 Drawing Figures

TURNING-BAR-LESS FOLDING MACHINE OF W-WIDTH ROTARY PRESS

BACKGROUND OF THE INVENTION

1. Field of the Invention

The present invention relates to a folding machine of a rotary press and, more particularly, to a folding machine which uses full-size travelling web (hereinunder referred to as "W-width web") the width of which corresponds to that of a 4-page newspaper, which uses no turning bars but other means for arranging the lateral position of the travelling web, gathering the slit webs or changing their route of travel, which is suitable for printed matter having many pages with each copy folded into several sections, and further which is capable of incorporating a color printed page into a desired position.

2. Description of the Prior Art

In this age of mass communication, there is a tendency to increase the number of pages contained in a single newspaper. In Japan, one newspaper consists of, for example, a 24- page section ("section" means one gathering unit), or two sections comprising 16 outside pages and 8 inside pages. In foreign countries, e.g., in America, the number of pages is further increased, for example, one newspaper may consist of a 40-page section (see FIGS. 3(C) and 7(C)), or two sections consisting of 28 outside pages and 12 inside pages, while sometimes newspaper printing is performed for a newspaper having three or four multi-page sections, such as 60 or 80 pages, per copy. In such newspaper printing, it is very important that however many pages or sections go to make up one newspaper, each newspaper must be made into one bundle in the delivery portion during the final process of newspaper printing so that it may be distinguished from others, because ambiguity would otherwise arise as to the unit represented by one newspaper since this is the fundamental unit for conveyance purposes.

The most conspicuous feature of the present invention is the development of a folding machine which can meet the demand for production of newspapers having a great number of pages. Although a conventional folding machine can meet such a demand, as will be described later, the present invention is distinguishable from the prior art in that it does not use any turning bar.

When newspapers having, e.g., a 40-page section per copy thereof (see FIG. 3(C)) are produced by a conventional folding machine, W-width travelling webs W1, W2, W3, W4 and W5 are fed to five single-color perfecting press units PU1, PU2, PU3, PU4 and PU5, respectively, which are disposed in parallel to each other, as shown in FIGS. 1 and 3. After printing is conducted on both sides, they are introduced to respective W-width drag rolls 25, where each printed web is longitudinally divided into two half-size webs (equivalent to the width of 2 pages) by a slitter knife 26 which is provided at the central portion of each roll in such a manner that its edge comes freely into and out of contact with the roll. One of these half-size slit webs, an upper half-size web in FIGS. 1 and 3, is fed directly to a folding machine, while the other half-size web is introduced to a turning bar mechanism 27 composed of a pair of bars arranged in parallel to each other at a position 45 degrees from the web to arrange the lateral position of webs. The turning bar mechanism 27 rotates the introduced half-size web such that the route of travel thereof agrees with that of the upper half-size web.

Thus, ten half-size webs with one placed on top of another are introduced into a right-hand side former 28R alone, as shown in FIG. 3(B), passed through a cross folder 29, and are discharged on a conveyor 30 in the form of a 40-page section newspaper 37 (FIG. 3(C)).

In a conventional W-width former folder, a slitter knife 32 is provided at the center of a drag roll 31 having a length of W-width such that the edge thereof freely comes into and out of contact with the roll. A pair of ½ W-width formers 28L and 28R are provided along the roll, a pair of ¼ W-width forming rolls 33 and 34 are provided right under the formers 28L and 28R, respectively, and further, below the ¼ pairs of W-width forming rolls, a pair of ½ W-width nipping rolls 35 and 36 are respectively disposed. Thus, as described above, the conventional folder has no mechanism for stacking a ½ W-width web travelling on one side on top of that travelling on the other side, and this function is left entirely to the turning bar mechanism.

The turning bar mechanism will now be discussed. A turn bar is, as is known, a rod which does not rotate, and the travelling web is made to slide along the peripheral surface thereof at a high speed and thus to turn toward a different direction. Sometimes, during this movement, the web is smeared when the printed surface with incompletely dried ink thereon is rubbed against the bar, or creases are produced on the web surface, thereby increasing the ratio of spoilage. At other times, creases lead to breakage of paper, which requires much labor and time for stopping all the operations of the machine, removal of the broken paper, re-insertion of a web, etc., and many materials are wasted, thereby reducing productivity to a considerable extent. In addition, the adjustment of the unbalanced tension between the travelling web which has passed through the turning bars and the one which has not passed therethrough is difficult, which constitutes an obstruction to high-speed operation, automatization, saving of man power, simplification of the structure and reduction in cost.

The aforementioned disadvantages also apply to formation of newspapers 38 having two sections of 28 outside pages and 12 inside pages per copy by a rotary press provided with a conventional folding machine, as shown in FIG. 4. A W-width web is longitudinally divided into two half-size webs by the slitter knife 26 on the drag roll 25. With respect to the uppermost travelling web W5 and the second uppermost travelling web W4 it is required that one of the half-size webs is introduced into the turning bar mechanism 27 to travel on the same route as the other half-size web. Thus, the above-described troubles caused by the use of the turning bar mechanism cannot be avoided.

With the progress of printing techniques, color-printed pages have recently been provided as well as single-color printed pages.

However, it is still not possible in terms of equipment and cost to realize coverage of all the pages of a newspaper with color printing. At present, color printing is often provided for the first page which is likely to attract the most attention. Nevertheless, the first page is usually filled with lead stories having news value, and is not always suitable for color printing which shows rather more artistic features. Thus freedom of arrangement when it is desired to incorporate color printing into any given page has been in demand.

Conventionally, the turning bar mechanism is also used for rearrangement of pages. As shown in FIG. 23, a satellite type color press unit LST is disposed at a position after the three single-color perfecting press units PUl, PU2 and PU3 and a former folder RF is disposed at the extreme downstream end. The travelling web W3 which is discharged from the adjacent single-color press unit PU3 is introduced to the color press unit LST, and all the travelling webs are simultaneously folded by the former folder. At this time, if the color printed portion (indicated by the symbol Δ) is situated on the first page where it may attract attention most or on the last page (a), as shown in FIG. 23(A), no turning bar mechanism is required. On the other hand, in order to locate a color-printed page at another position, it is necessary, for example, as shown in FIG. 23(B), to reverse the sides of the travelling web W3 and further to change its route of travel beneath the route of the other travelling webs W1 and W2 to above the same. It is therefore necessary to provide two turning bars and two bay window rolls (not shown) exclusively for this purpose, and to pass the travelling web W3 therethrough. Thus, here again, the above-described troubles caused by the use of a turning bar mechanism cannot be avoided.

SUMMARY OF THE INVENTION

Accordingly, it is an object of the present invention to eliminate the above-described disadvantages and to provide a folding machine of a W-width rotary press which does not use a turning bar at all in producing newspapers or printing of a great number of pages forming one copy, thereby eliminating all the above-described defects caused by the interposition of turning bars. This ensures clearly printed pages and is capable of reducing the ratio of spoilage and breakage of paper, increasing in operational speed and, hence, enhancing productivity, facilitating tension adjustment, and promoting automatization and simplification of operation, reduction in man power, simplification of the structure and reduction in cost.

It is another object of the present invention to provide a folding machine of a W-width rotary press which is capable of both incorporating a color printed page at a desired position within a newspaper or a printed matter which has a great number of pages without using turning bar, thereby eliminating all the above-described defects caused by the interposition of turning bars.

To achieve this aim, a folding machine according to the present invention is composed of a slitting and gathering mechanism for longitudinally dividing W-width travelling webs into two parts and overlaying one web on the other, the mechanism being mainly constituted by a former having the configuration of an inverted triangle with the base having a length equivalent to the W-width of a travelling web, and a slitter knife; a vertical pair of longitudinally folding mechanisms for longitudinally folding the ½ W-width travelling webs into two parts which is mainly constituted by a pair of formers having the configuration of an inverted triangle with the base having a length equivalent to the ½ W-width of the travelling webs, the pair being vertically disposed on the downstream side of the slitting and gathering mechanism at the same position with respect to the lateral direction of the travelling webs; a cross cutting and folding mechanism for cutting and folding the ¼ W-width travelling webs in the lateral direction thereof, the mechanism being provided immediately on the downstream side of the lower longitudinally folding mechanism; a conveying means for distributing the ½ W-width travelling webs which are discharged from the slitting and gathering mechanism equally or unequally into the upper and lower longitudinally folding mechanisms; and a means for combining the route for the ¼ W-width travelling webs which are discharged from the upper folding mechanism with the route of those which are discharged from the lower folding mechanism. In another aspect of the present invention, a folding machine is further composed of a first color printed page rearranging means for introducing all or a part of the W-width travelling webs to the W-width former from the opposite direction; and/or a second color printed page rearranging means for introducing all or a part of the ½ W-width travelling webs around the W-width former to either or both of the longitudinally folding mechanisms; and/or a third color printed page rearranging means for introducing all or a part of the ½ W-width travelling webs around the upper longitudinally folding machine to the lower longitudinally folding machine; and/or a machine bed for supporting the entire folding machine having a feeding mechanism provided on the floor; and/or a combining means used for folding 3 or 4 sections when two folding machines are combined in parallel; and/or a single cross cutting and folding mechanism provided in the parallel combination type folding machine.

The above and other objects, features and advantages of the present invention will become clear from the following description of the preferred embodiments thereof, taken in conjunction with the accompanying drawings.

BRIEF DESCRIPTION OF THE DRAWINGS

FIG. 14(A) is an elevational view of the W-width former shown in FIG. 11, illustrating the position at which the color printed page is incorporated when the travelling webs discharged from the W-width former are equally delivered to the upper and lower ½ W-width formers;

FIG. 14(B) is an explanatory right-hand side elevational view of the upper ½ W-width former;

FIG. 14(C) is an explanatory right-hand side elevational view of the lower ½ W-width former;

FIGS. 23(*a*) and 23(*b*) depict web alignment above station RF.

DESCRIPTION OF THE PREFFERED EMBODIMENTS

Figure 1:
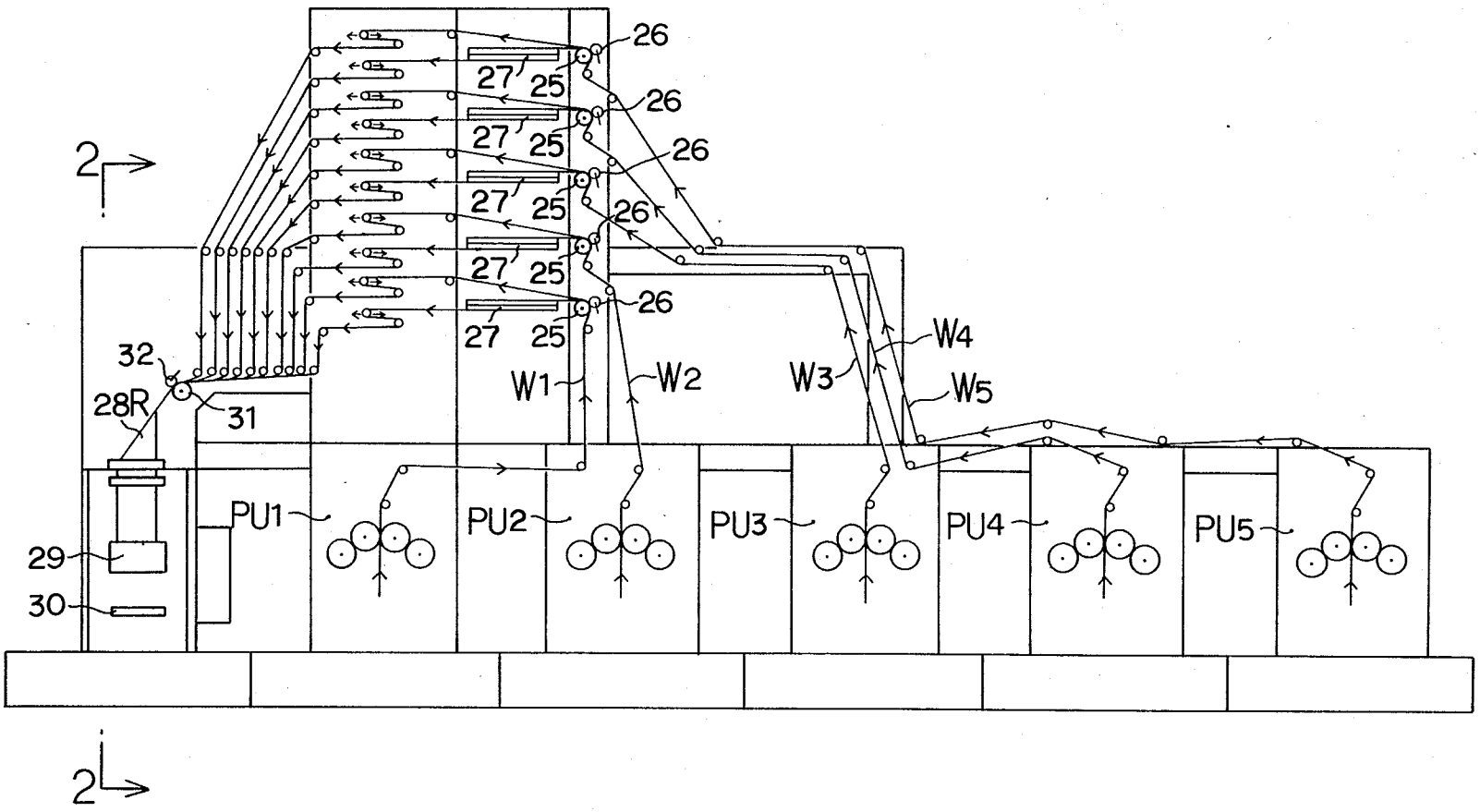
FIG. 1 is a right-hand side elevational view of an example of the entire arrangement of a conventional rotary press for producing a newspaper consisting of 40 pages.
Figure 2:
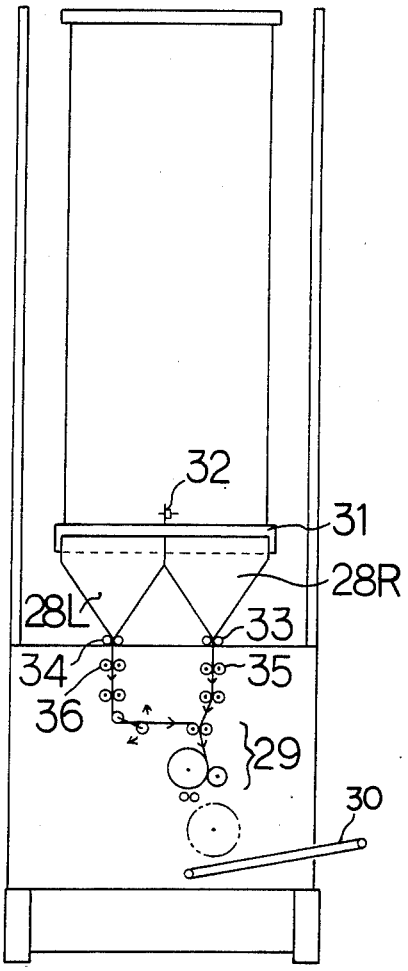
FIG. 2 is an enlarged elevational view of the rotary press shown in FIG. 1, viewed in the direction of the line 2—- 2.

The structure and operation of the present invention will be described in detail hereinunder with respect to the accompanying drawings.

Referring to first FIGS. 5 to 22, the base of an inverted triangular former 40 has a length equivalent to the W-width of the travelling web, and a W-width drug roll 41 is provided right above the former 40 with a slitter knife 42 attached to the central portion thereof such that the edge of the slitter knife 42 is able to come freely into and out of contact with the former 40. A pair of ½ W-width forming rolls 43 are provided right under the former 40, and further below the forming rolls 43, a pair of nipping rolls 44 are provided.

Five, for example, travelling webs Wl, W2, W3, W4 and W5 are supplied to press units PUl, PU2, PU3, PU4 and PU5, respectively, subjected to single-color printing on both sides thereof, and thereafter introduced directly to the former 40 not through any turning bar. The travelling webs are longitudinally divided into two portions by the slitter knife 42 provided right above the former 40 and the divided ½ W-width webs are stacked on each other by the forming rolls directly under the former 40. Thus, the W-width travelling web slitting and gathering mechanism in accordance with the present invention dispenses with the need for a conventional turning bar.

The folding machine according to the present invention is further provided with a vertical pair of ½ W-width formers 45 and 46 in the same direction on the downstream side of the slitting and gathering mechanism, in order to deal with the printing of a newspaper having a great number of pages. The pair of formers 45 and 46 with the base of an inverted triangle having a length equivalent to the W-width of the travelling web are vertically provided at the same position with respect to the lateral direction of the travelling web. Immediately on the upstream sides of the formers 45 and 46 are provided ½ W-width drag rolls 47 and 48, respectively, and immediately on the downstream sides thereof are provided pairs of ¼ W-width forming rolls 49 and 50, respectively. A pair of ¼ W-width nipping rolls 51 and 52 are further provided on the respective downstream sides of the pairs of forming rolls 49, and 50. Thus, when the ½ W-width travelling webs are introduced into either of the upper and lower longitudinally folding mechanisms, they are folded into ¼ W-width, namely, the width of one page of a newspaper, and are stacked on each other.

The present invention, however, is not limited to the above described example in which the ½ W-width travelling webs discharged from the slitting and gathering mechanism are equally distributed to the upper and lower folding mechanisms, and it is possible to introduce the travelling webs unequally to the upper and lower folding mechanisms by distributing the ½ W-width travelling webs which have passed through second ½ W-width nipping rolls 64 to introduction rolls 53 for the upper folding mechanism and introduction rolls 54 for the lower folding mechanism, respectively, in the ratio of, e.g., 4 : 6, 3 : 7, 2 : 8, and 1: 9, if the ½ W-width travelling webs are stacked in 10 layers. This means for unequal distribution is effectively utilized for folding a newspaper consisting of two sections and rearranging a color printed page. The space between the right-hand and left-hand introduction rolls is also utilized for adjusting the deviation in the lateral direction of the travelling webs.

A cross cutting and folding mechanism which is provided with a ¼ W-width folding drum 55, a ¼ W-width serrated drum 56 and a pair of second folding rolls 67 is disposed immediately on the downstream side of the longitudinally folding mechanisms to cross cut and fold ¼ W-width travelling webs, and further on the downstream side thereof is provided a delivery mechanism composed of a fan 58 and a conveyor 59.

In the present invention, in order to deal with the printing of a newspaper having a great number of pages, the ¼ W-width travelling webs which are discharged separately from the upper and lower folding mechanisms are gathered immediately before they are introduced to the cross cutting and folding mechanism.

Figure 5:
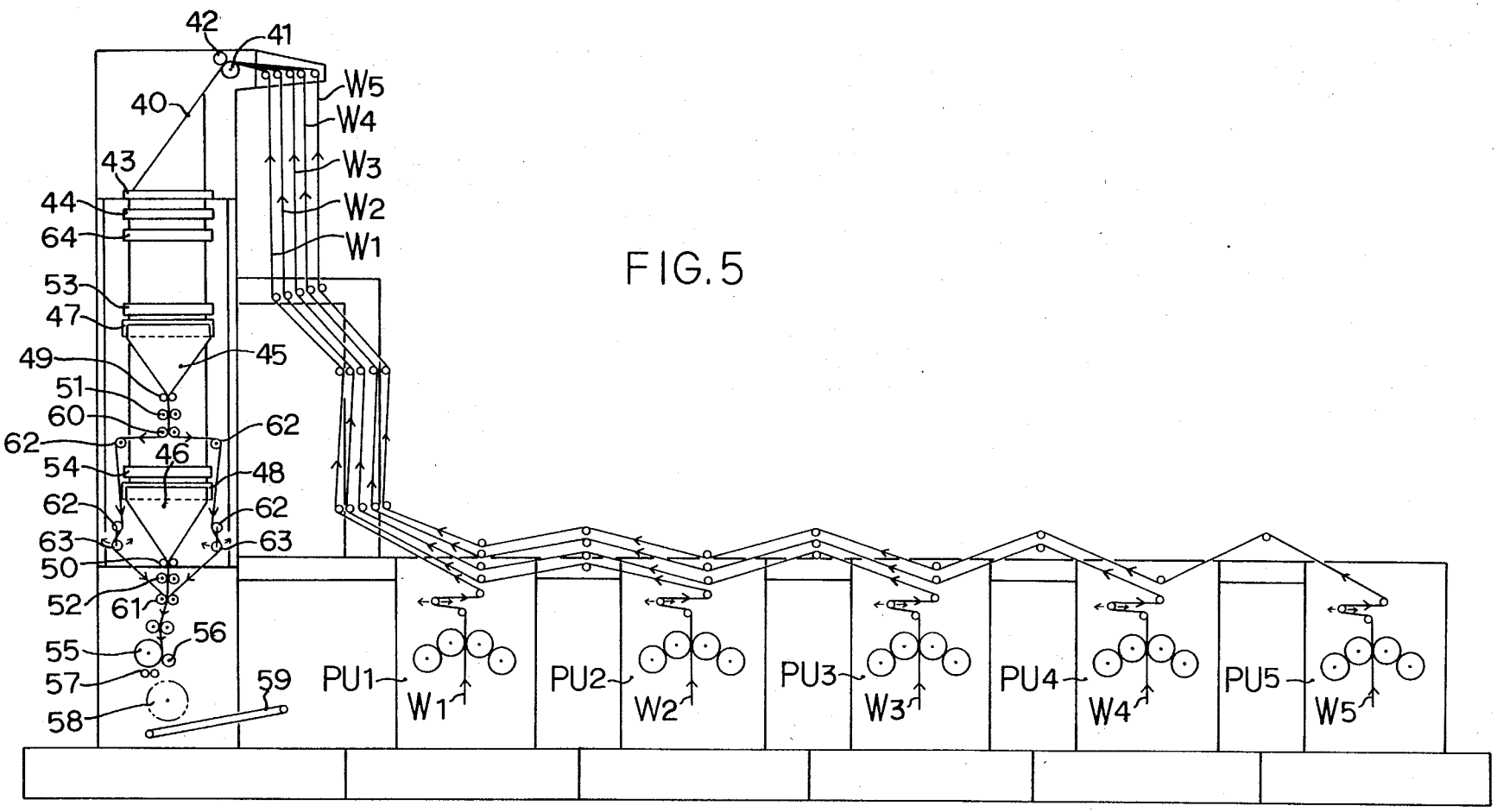
FIG. 5 is a right-hand side elevational view of the entire arrangement of a rotary press in accordance with the present invention for producing newspapers consisting of a 40-page section.

As shown in FIG. 5, the ½ W-width travelling webs which have passed through the nipping rolls 51 of the upper folding mechanism pass through the second nipping rolls 60, are introduced to third nipping rolls 61 provided immediately on the downstream side of the nipping rolls 52 of the lower folding mechanism through a detour on the right-hand or left-hand side of the lower ½ W-width former 46. The combining means is composed of a pair of detour guide rolls 62 and a pair of adjust rolls 63.

As will be understood from the above explanation, since no turning bar is employed in the present invention, the positional relationships which will be described in the following are essential between the W-width former 40 and the vertical pair of W-width formers 45 and 46.

First, it is necessary to dispose the vertical pairs of W-width formers 45 and 46 on the downstream side of the W-width former 40 at the same position with respect to the lateral direction of the travelling webs so as to introduce the W-width travelling webs which are discharged from the W-width former 40 (see FIG. 5).

Figure 6:
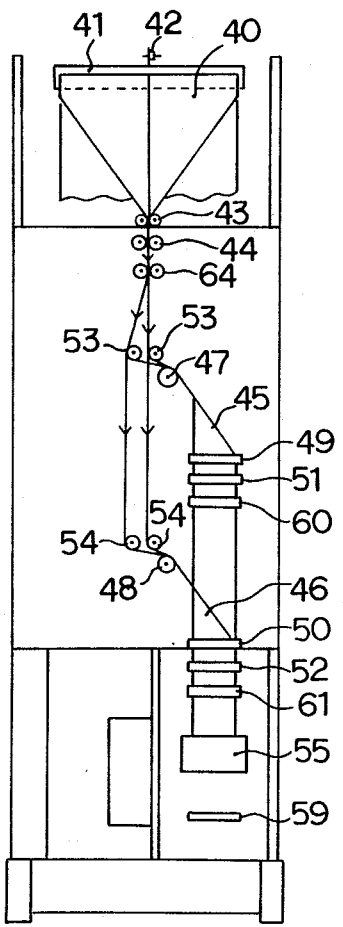
FIG. 6 is an enlarged elevational view of the rotary press shown in FIG. 5, viewed from the left-hand side.

Secondly, it is also necessary to vertically dispose the pair of W-width formers 45 and 46 at the same position with respect to the lateral direction of the travelling webs so as to stack the W-width travelling webs discharged from the respective formers on each other (see FIG. 6). Accordingly, although the two W-width formers may be faced to either the right or the left, the direction must be the same.

Figure 3:
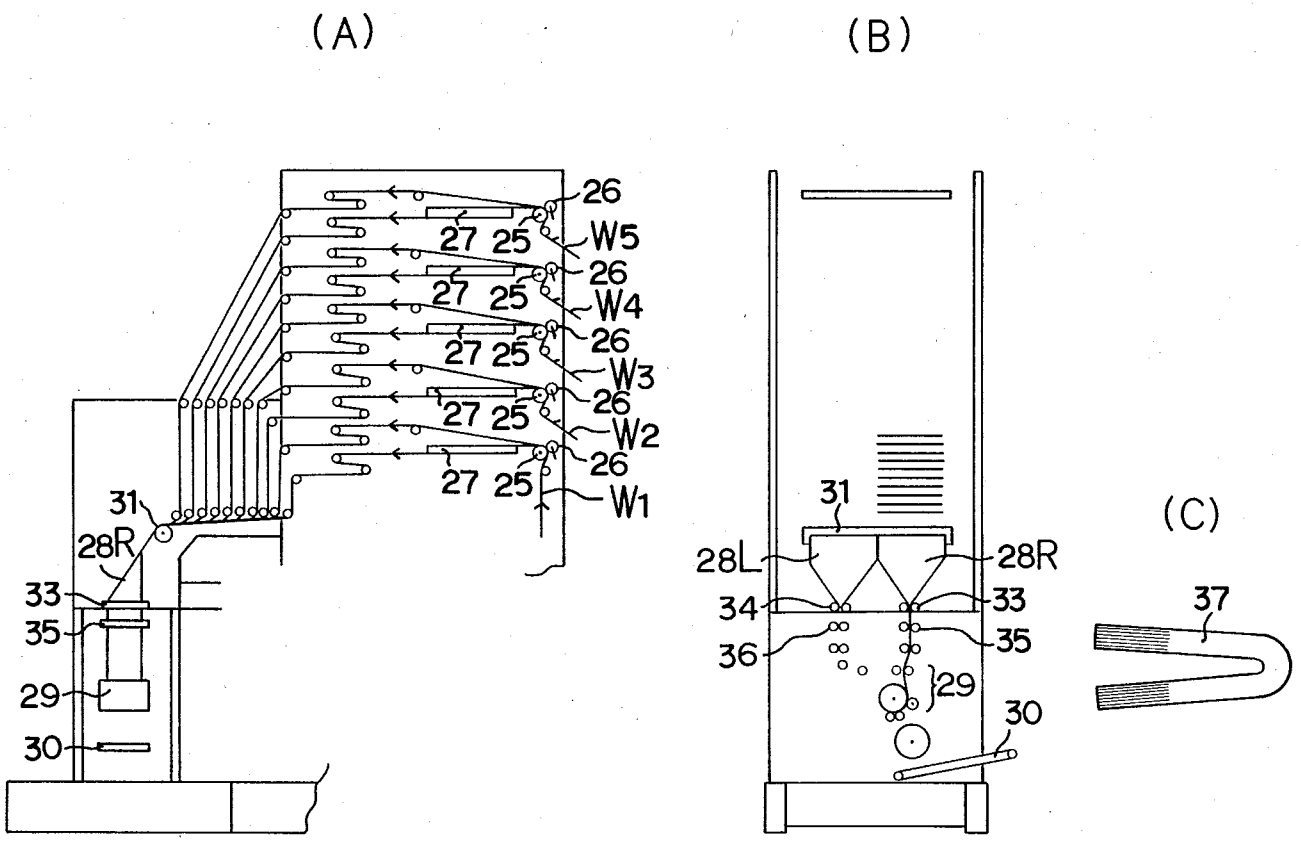
FIGS. 3(A) and 3(B) are a right-hand side elevational view and an enlarged elevational view, respectively, of the folding machine of the rotary press shown in FIG. 1, which is necessary for production of a newspaper 37 having 40 pages, with FIG. 3(C) illustrating the folded, cross cut and gathered state thereof.
Figure 7:
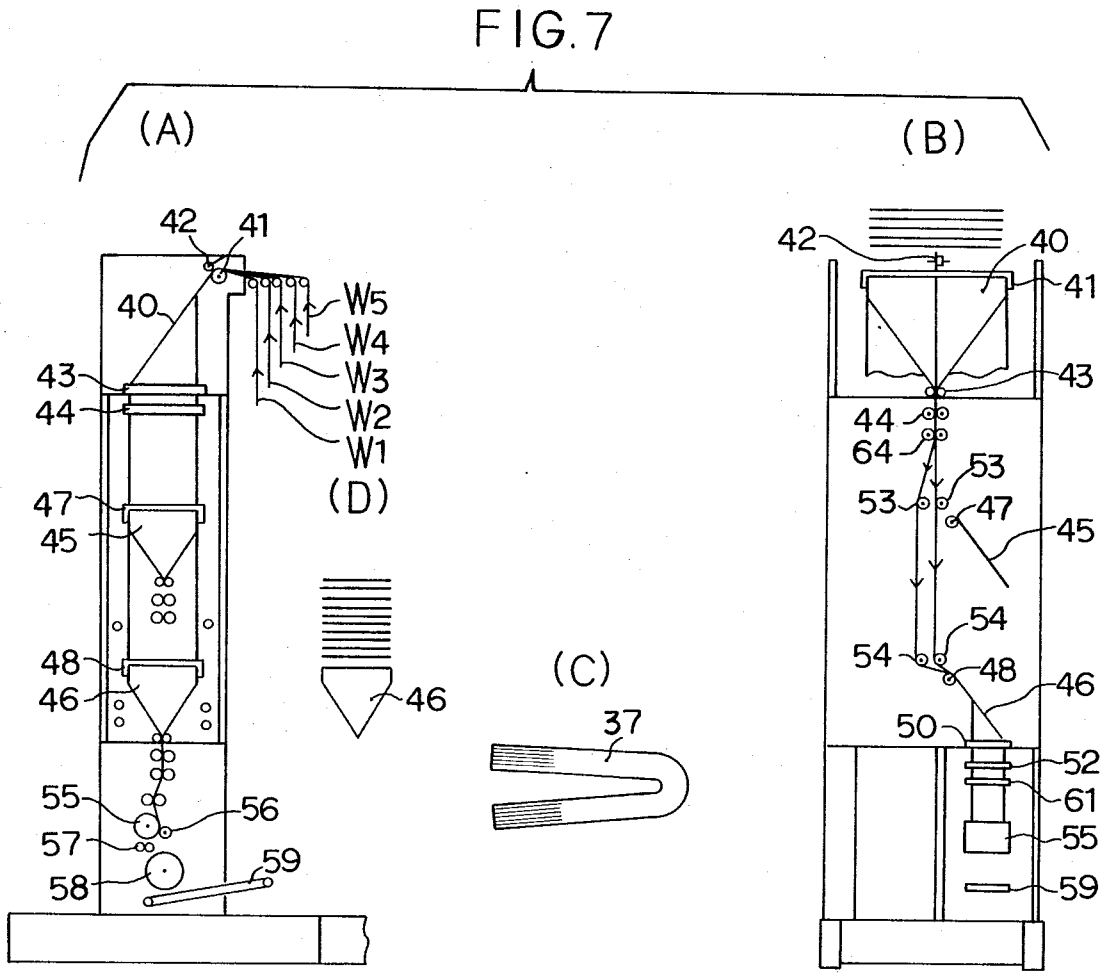
FIG. 7(A) is a right-hand side elevational view of a folding machine of the rotary press shown in FIG. 5, which is necessary for production of a newspaper 37 having 40 pages, with FIG. 7(C) illustrating the folded, cross cut and gathered state thereof.
FIG. 7(B) is an enlarged view of the folding machine shown in FIG. 7(A)
FIG. 7(D) is an explanatory view of the ½ W-width travelling webs to be introduced to the lower ½ W-width former.

The production of a 40-page section newspaper 37 by means of the folding machine having the above-described structure will be explained as compared with the prior art, referring to FIGS. 7 and 3, respectively. Five-layered W-width travelling webs W1 to W5 are divided into right-hand and left-hand W-width travelling webs by the slitter knife 42 on the drag roll 41, introduced into the W-width former 40, and stacked on each other by the forming rolls 43 immediately under the former 40. The five travelling webs on the left-hand side are passed through the left-hand rolls 53 and 54, while the five travelling webs on the right-hand side are passed through the right-hand rolls 53 and 54, and both reach the drag roll 48 of the lower folding mechanism. The drag roll 48 gathers them again into ten layers and feed them to the lower ½ W-width former 46. The travelling webs are folded into ¼ W-width by the forming roll 50 immediately under the ½ W-width former 46, so that one section consisting of 40 pages is formed. The 40-page section is further passed through the folding drum 55, serrated drum 56 and a second folding roll 57, whereby it is cross cut and is discharged from the fan 58 and the conveyor 59 subsequently in the form of the one 40-page section newspaper 37. During this process for producing the multi-page newspaper no turning bar is employed which has conventionally been considered to be essential.

Figure 4:
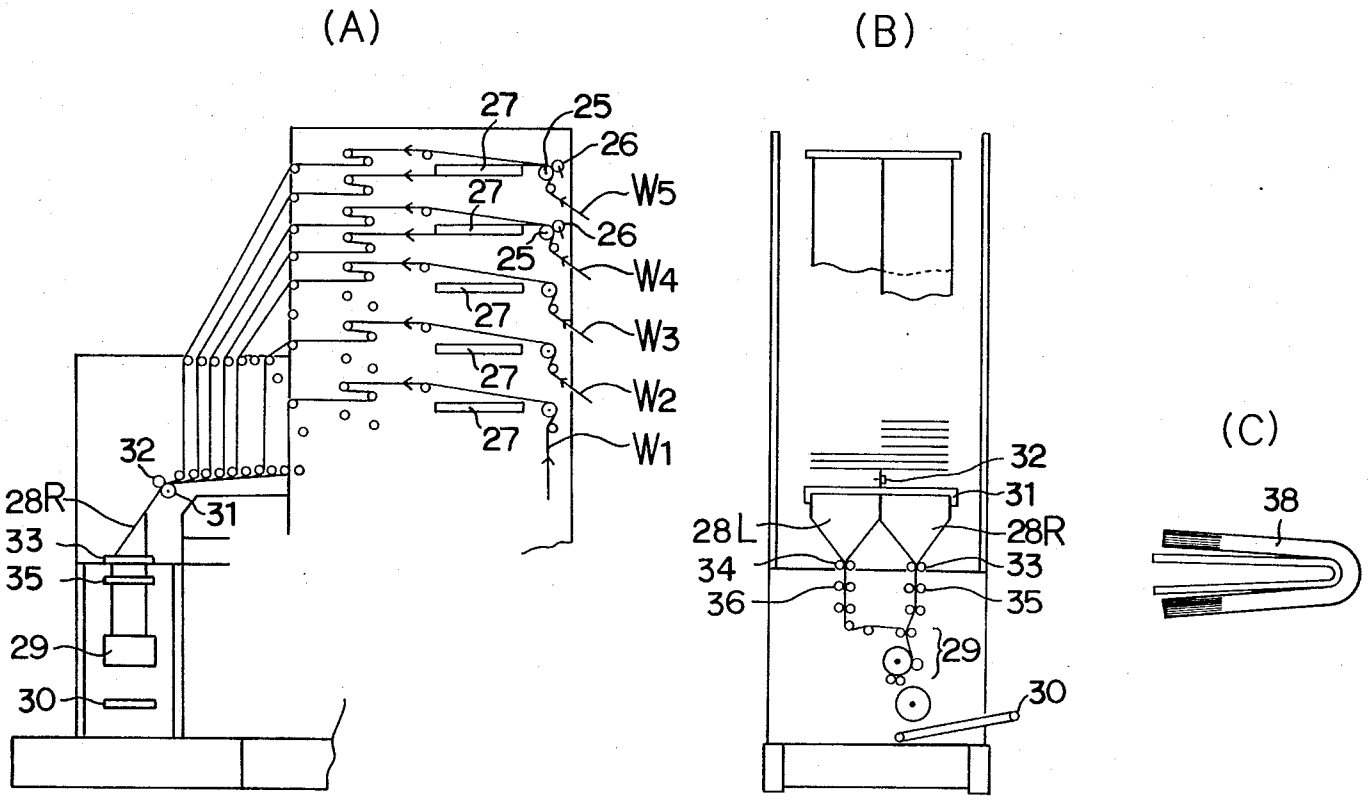
FIGS. 4 (A) and 4(B) are a right-hand side elevational view and an enlarged elevational view, respectively, of the folding machine of the rotary press shown in FIG. 1, which is necessary for production of a newspaper 37 consisting of 2 sections comprising 28 outside pages and 12 inside pages, with FIG. 4(C) illustrating the folded, cross cut and gathered state thereof.
Figure 8:
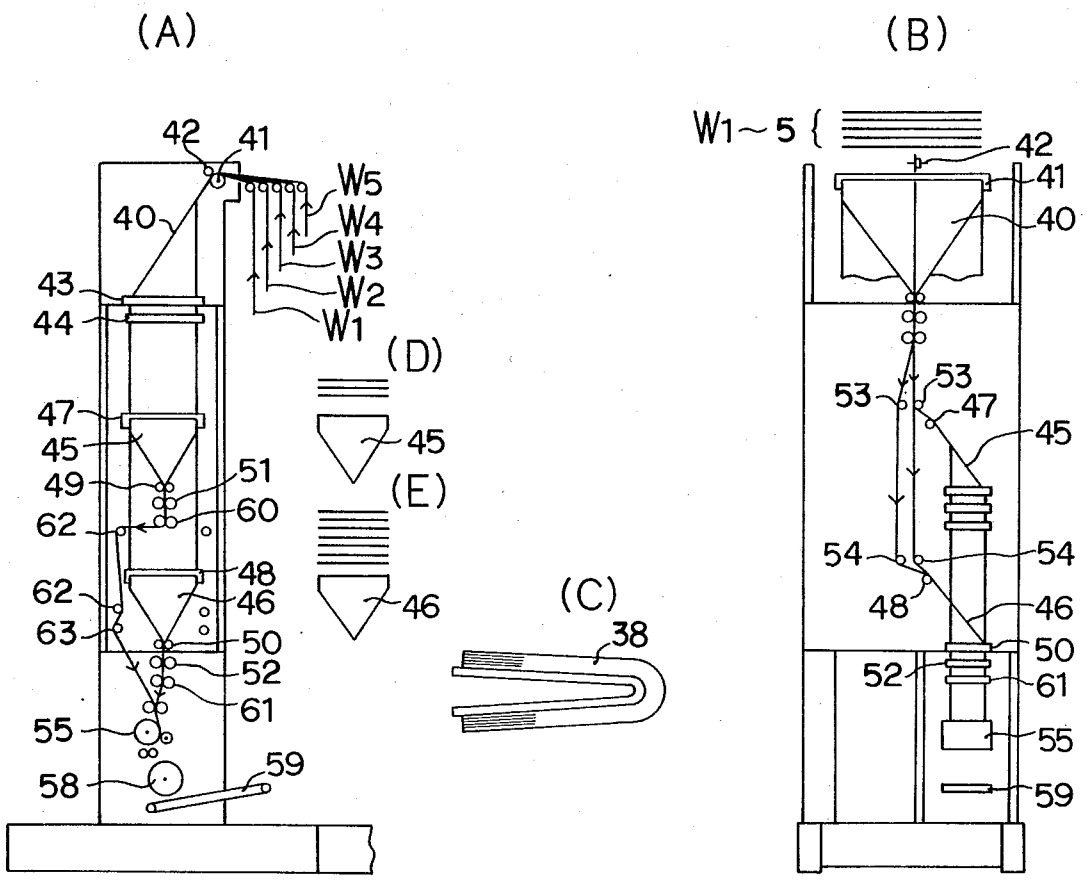
FIG. 8(A) is a right-hand side elevational view of a folding machine of the rotary press shown in FIG. 5, which is necessary for production of a newspaper 37 consisting of 2 sections comprising 28 outside pages and 12 inside pages, with FIG. 8(C) showing the folded, cross cut and gathered state thereof.
FIG. 8(B) is an enlarged view of the folding machine shown in FIG. 8(A)
FIG. 8(D) is an explanatory view of the ½ W-width travelling webs to be introduced to the upper ½ W-width former.
FIG. 8(E) is an explanatory view of the ½ W-width travelling webs to be introduced to the lower ½ W-width former.

The production of a newspaper 38 having outside 20 pages and inside 12 pages per copy thereof will next be explained with reference to FIG. 8 as compared with the prior art (FIG. 4). Five-layered W-width travelling webs W1 to W5 are divided into the right-hand and left-hand ½ W-width travelling webs by the slitter knife 42 on the drag roll 41, introduced into the W-width former 40, and stacked on each other by the forming rolls 43 immediately under the former 40. The five travelling webs on the left-hand side and two travelling webs on the right-hand side are introduced to the the lower ½ W-width former 45, and the other three travelling webs on the right-hand side are introduced to the upper ½ W-width former 45, so as to be folded into ½ W-width by the respective formers 46 and 45. Thereafter the upper three ¼ W-width travelling webs are passed through the detour rolls 62 and 63 and join the the lower seven ¼ W-width travelling webs. The gathered travelling webs are together cross cut and folded into two, and are discharged subsequently from the conveyor 59 in the form of the newspaper 38 consisting of two sections comprising the outside 28 pages and inside 12 pages. In this manner, the present invention enables the above-described multi-page newspaper to be produced without using any turning bar at all.

Figure 9:
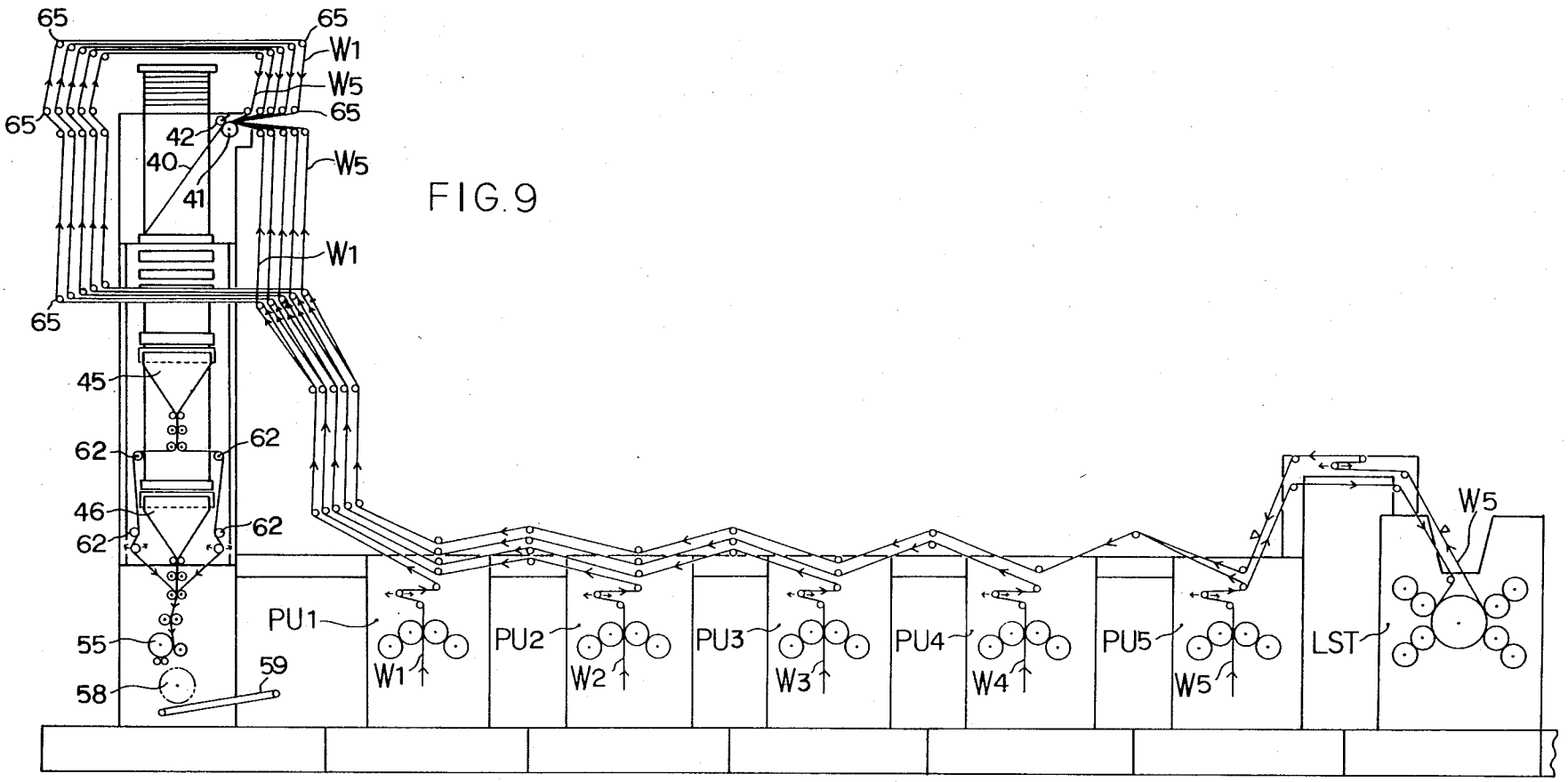
FIG. 9 is a right-hand side elevational view of the rotary press shown in FIG. 5, illustrating the ordinary route and a first color printed page rearranging means which is used when adding a color printed page to one side of a travelling web.
Figure 10:
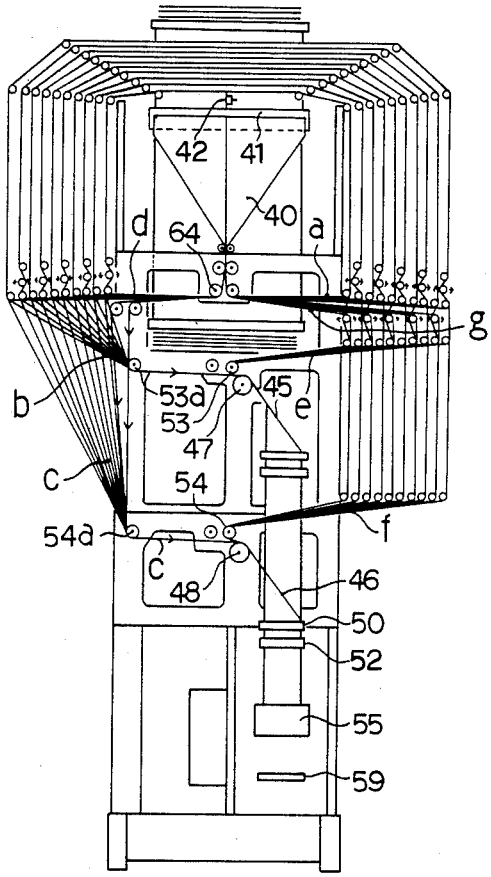
FIG. 10 is an enlarged elevational view of the rotary press shown in FIG. 9, viewed from the left-hand side, illustrating second and third rearranging means.
Figure 23A:
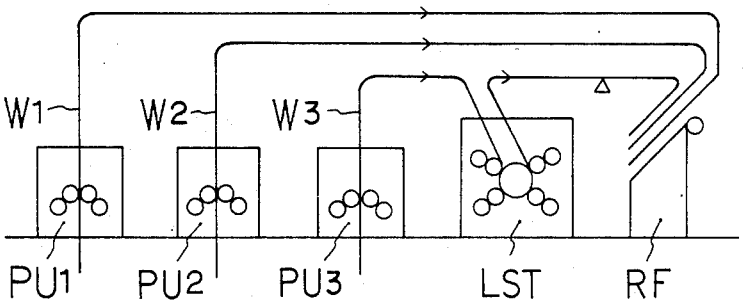
FIGS. 23(A) and 23(B) are explanatory views of examples of known conventional arrangements of a color printed page.
Figure 23A:
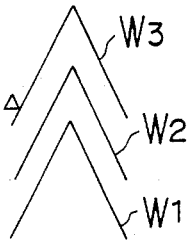
Figure 23B:
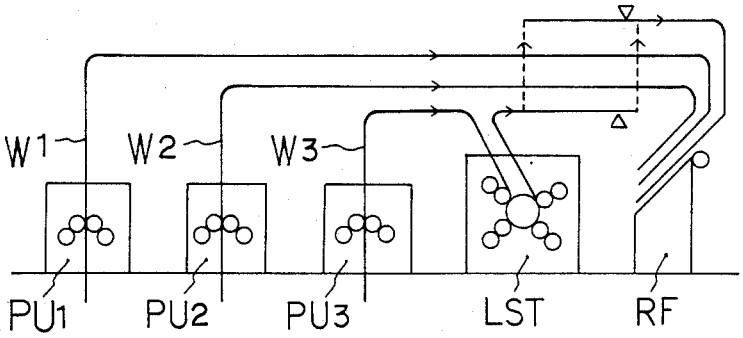
Figure 23B:
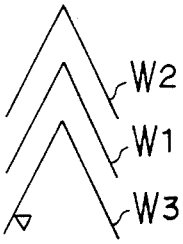

FIGS. 9 and 10 show a further improvement of the above-described fundamental structure of the present invention. Three kinds of color printed page rearranging means are added so as to meet the demands for variety in arrangement of the colored page by increasing the degree of freedom of arrangement.

Figure 11:
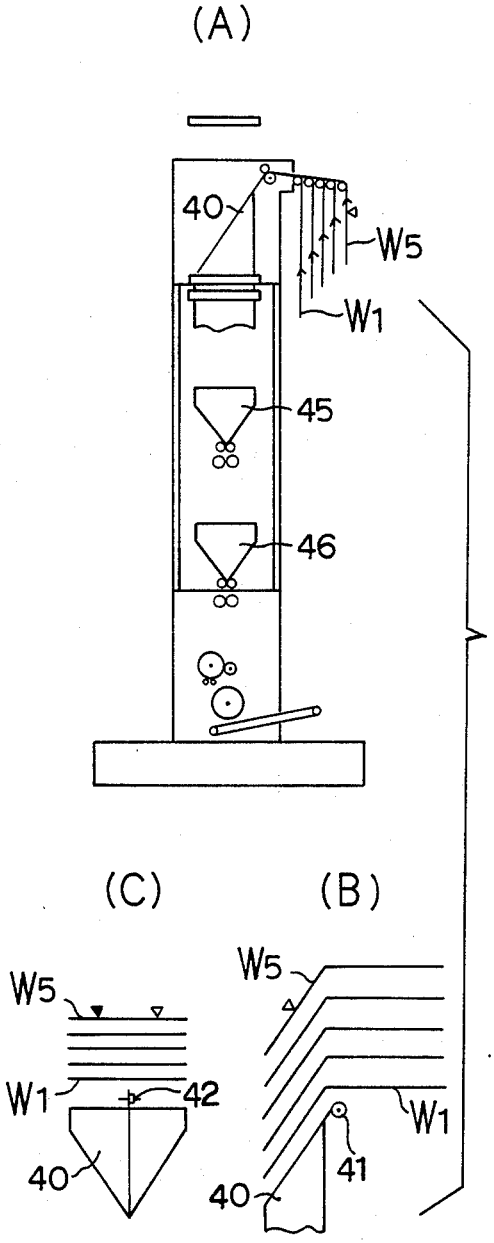
FIG. 11(A) is a right-hand side elevational view of the W-width former shown in FIG. 9, showing a state in which color printing is placed on the upper surface of the uppermost travelling web through the ordinary route.
FIG. 11(B) is an explanatory enlarged right-hand side elevational view of the main part thereof.
FIG. 11(C) is an explanatory elevational view thereof.
Figure 12:
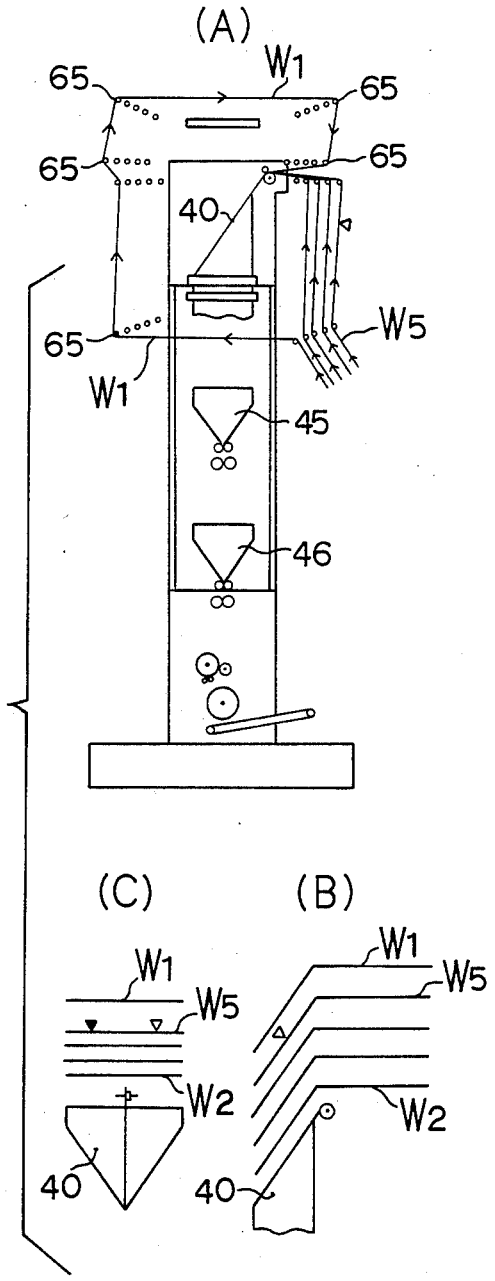
FIG. 12(A) is a right-hand side elevational view of the W-width former shown in FIG. 9, showing a state in which a color printed page is placed on the upper surface of the second uppermost travelling web by the first rearranging means.
FIG. 12(B) is an explanatory enlarged right-hand side elevational view of the main part thereof.
FIG. 12(C) is an explanatory elevational view thereof.
Figure 13:
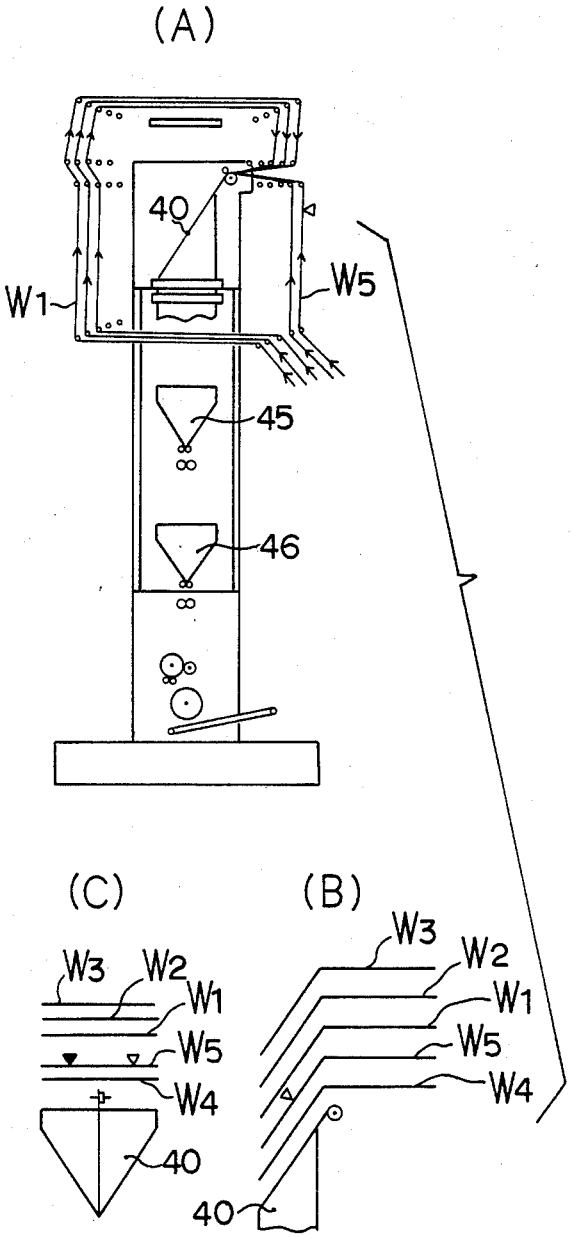
FIG. 13(A) is a right-hand side elevational view of the W-width former shown in FIG. 9, showing a state in which a color printed page is placed on the upper surface of the second lowermost travelling web by the first rearranging means.
FIG. 13(B) is an explanatory enlarged right-hand side elevational view of the main part thereof.
FIG. 13(C) is an explanatory elevational view thereof.

A first rearranging means is composed of a series of guide rolls 65 for introducing all or a part of the travelling webs Wl to W5 to the W-width former 40 from the opposite direction through a space having a width equivalent to the W-width (see FIG. 9) formed at the central portion of the route of the conveying means for distributing the ½ W-width travelling webs which are discharged from the ½ W-width former 40 to the upper and lower ½ W-width formers 45 and 46, respectively, by shifting the route of the conveying means to the left side by the distance corresponding to at least ½ W-width (sew FIG. 10). By utilizing the first rearranging means, it is possible to change the position of the color printed page ▽ which is placed at the top of the travelling webs on the ordinary route, as shown in FIG. 11, to the upper surface of the second uppermost web by introducing the lowermost W-width travelling web W5 to the W-width former 40 through the series of guide rolls 65, as shown in FIG. 12. Further, as shown in FIG. 13, it is possible to change the position of the color printed page to the upper surface of the fourth travelling web from the top by introducing the lower three travelling webs Wl to W3 to the former 40 through the series of guide rolls 65. In this manner, it is possible to change freely the position of the color printed page ▽ to a given upper surface of the uppermost to the lowermost travelling webs.

Figure 17:
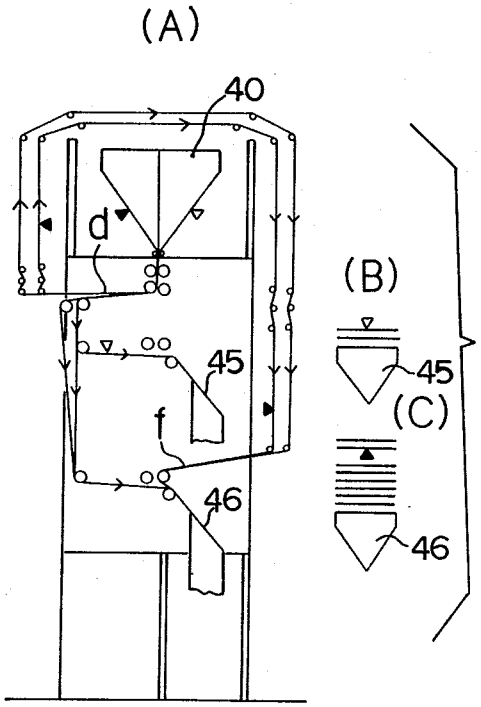
FIG. 17(A) is an elevational view of the W-width former shown in FIG. 11, illustrating the position at which the color printed page is incorporated when a part of the travelling webs discharged from the W-width former are delivered to the lower ½ W-width former by the second rearranging means, another part to the upper ½ W-width former, and the other travelling webs to the lower ½ W-width former.
FIG. 17(B) is an explanatory right-hand side elevational view of the upper ½ W-width former.
FIG. 17(C) is an explanatory right-hand side elevational view of the lower ½ W-width former.

The second rearranging means is, as shown in FIG. 10, a means for introducing all or a part of the five ½ W-width travelling webs on the right-hand or left-hand side which are discharged from the W-width former 40, (1) to the upper W-width former 45 from (b) on the left-hand side around the W-width former 40 counterclockwise from (a) on the ½ right-hand side, (2) to the lower ½ W-width former 46 from (c) on the left-hand side around the W-width former 40 counterclockwise from (a) on the right-hand side, (see FIGS. 18 and 19), (3) to the upper ½ W-width former 45 from (e) on the right-hand side around the W-width former 40 counterclockwise from (d) on the left-hand side (see FIG. 19), or to the lower ½ W-width former 46 from (f) on the right-hand side around the W-width former 40 from (d) on the left-hand side (see FIG. 17).

Figure 15:
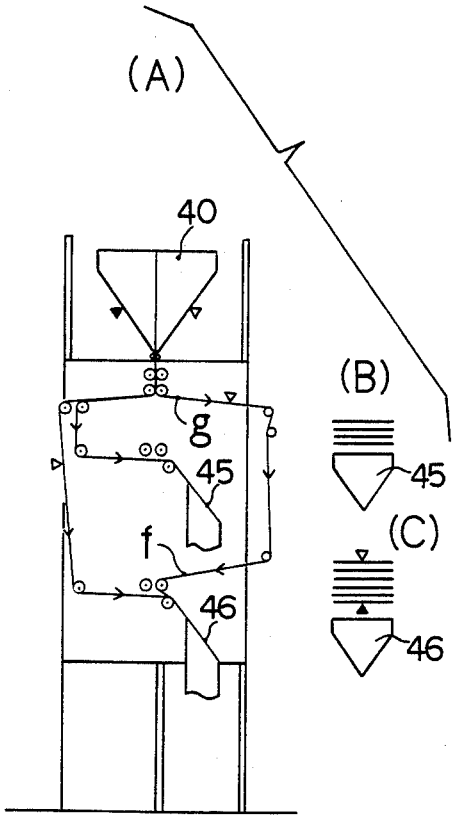
FIG. 15(A) is an elevational view of the W-width former shown in FIG. 11, illustrating the position at which the color printed page is incorporated when the travelling webs discharged from the W-width former are delivered to the upper and lower W-width formers in the ratio of 4 : 6.
FIG. 15(B) is an explanatory right-hand side elevational view of the upper ½ W-width former.
FIG. 15(C) is an explanatory right-hand side elevational view of the lower ½ W-width former.

The third rearranging means is, as shown in FIG. 10, a means for introducing all or a part of the five ½ W-width travelling webs which are discharged from the W-width former 40 to the lower ½ W-width former 46 from (f)through a detour in front of the upper ½ W-width former 45 from (g) on the right-hand side (see FIG. 15).

Figure 14:
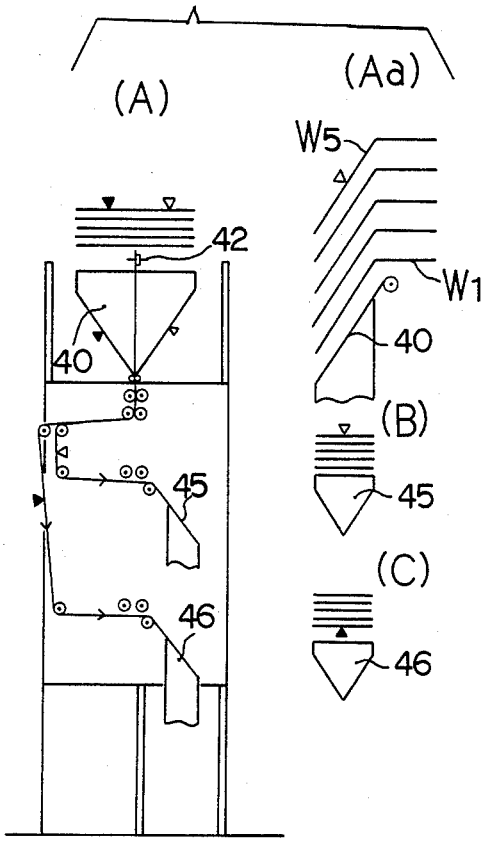
FIG. 14(Aa) is a right-hand side elevational view thereof.

FIG. 14 illustrates a fundamental route which does not employ any of the above-described rearranging means. When the five-layered W-width travelling webs which are divided into two by the slitter knife 42 and stacked on each other into ten ½ W-width travelling webs by the W-width formers 40 are distributed so that the five ½ W-width travelling webs on the right-hand side proceed to the upper ½ W-width former 45 and the five ½ W-width travelling webs on the left-hand side proceed to the lower ½ W-width former 46, the color printed page (white ▽) on the right hand side is delivered to the upper surface of the uppermost travelling web among the five travelling webs (see FIG. 14(B)), while the color printed page (black ▽) on the left-hand side is delivered to the under surface of the lowermost travelling web among the five travelling webs (see FIG. 14 (C)).

In contrast, referring to FIG. 15, the uppermost travelling web of the right-hand side travelling webs, namely, the travelling web having the color printed page on the upper surface thereof is introduced to the lower ½ W-width former 46 through the route of the third rearranging means. As a result, the travelling webs on the lower W-width former 46 are stacked in six layers and are rearranged such that the color printed pages are delivered to the upper surface of the uppermost travelling web and the under surface of the lowermost travelling web, as shown in FIG. 15 (C).

Figure 16:
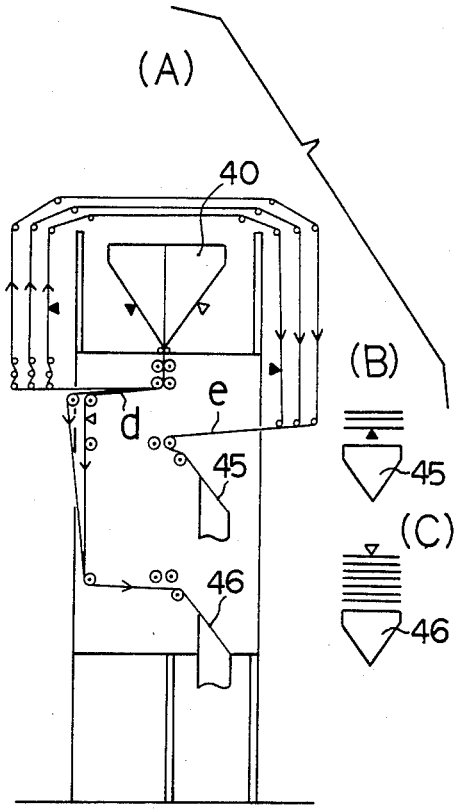
FIG. 16(A) is an elevational view of the W-width former shown in FIG. 11, illustrating the position at which the color printed page is incorporated when a part of the travelling webs discharged from the W-width former are delivered to the upper ½ W-width former by the second rearranging means and the other travelling webs are delivered to the lower ½ W-width former.
FIG. 16(B) is an explanatory right-hand side elevational view of the upper ½ W-width former.
FIG. 16(C) is an explanatory right-hand side elevational view of the lower ½ W-width former.

Referring to FIG. 16, the outer three travelling webs on the left side are introduced to the upper ½ W-width former 45 by the second rearranging means, while the inner two travelling webs on the left side and the five travelling webs on the right side are introduced to the lower ½ W-width former 46. As a result, the travelling webs on the upper former 45 are stacked in three layers with the color printed page (black ▽) delivered to the under surface of the lowermost travelling web, as shown in FIG. 16(B), whereas the travelling webs on the lower former 46 are stacked in seven layers with the color printed page (white ▽) delivered to the upper surface of the uppermost travelling web, as shown in FIG. 16(C).

In FIG. 17, the outer two travelling webs on the left-hand side are introduced to the lower ½ W-width former 46 through the (4) of the second rearranging means, the inner two travelling webs on the left-hand side and the inner three travelling webs on the right-hand side are introduced directly to the lower former 46, and the outer two travelling webs on the right hand side are introduced to the upper ½ W-width former 45. As a result, the travelling webs on the upper former 45 are, as shown in FIG. 17(B), stacked in two layers with the color printed page (white ▽) delivered to the upper surface of the upper travelling web, while the travelling webs on the lower former 46 are, as shown in FIG. 17(C), stacked in eight layers with the color printed page (black ▽) delivered to the under surface of the second uppermost travelling web.

Figure 18:
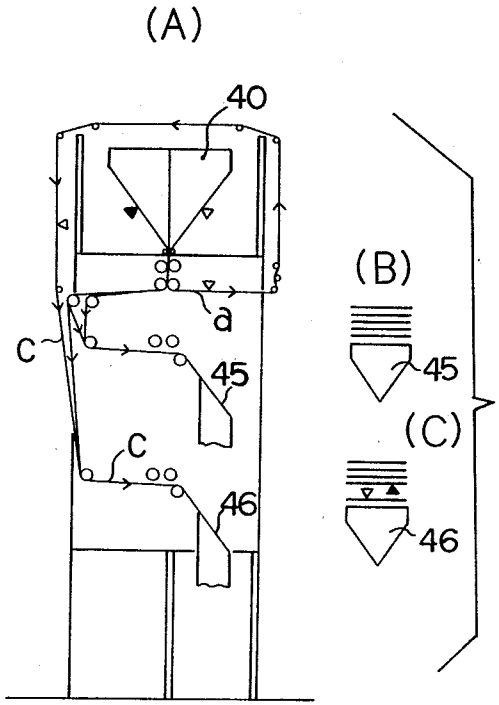
FIG. 18(A) is an elevational view of the W-width former shown in FIG. 11, illustrating the position at which the color printed page is incorporated when a part of the travelling webs discharged from the W-width former are delivered to the lower W-width former by the second rearranging means, and the other travelling webs are equally distributed to the upper and lower W-width formers.
FIG. 18(B) is an explanatory right-hand side elevational view of the upper W-width former.
FIG. 18(C) is an explanatory right-hand side elevational view of the lower W-width former.

Referring to FIG. 18, the outermost travelling web on the right-hand side is introduced to the lower former 46 through the route (2) of the second rearranging means, while the innermost travelling webs on the left-hand side is introduced to the upper former 45, and the other four travelling webs on the right and left sides, respectively, are directly introduced to the upper former 45 and the lower former 46, respectively. As a result, the travelling webs on the upper former 45 are, as shown in FIG. 18(B), stacked in five layers of single-color printed pages, while the travelling webs on the lower former 46 are, as shown in FIG. 18(C), stacked in five layers with the color printed pages (black ▽ and white ▽) delivered to the under surface of the fourth travelling web and the upper surface of the fifth travelling web, respectively, from the top.

Figure 19:
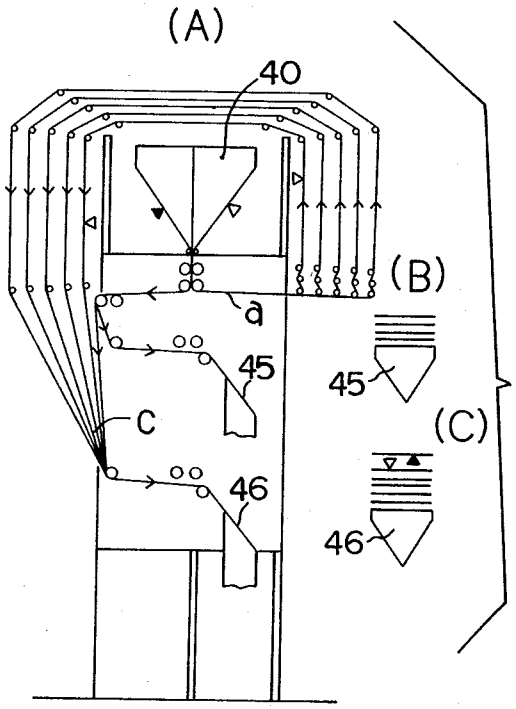
FIG. 19(A) is an elevational view of the W-width former shown in FIG. 11, illustrating another example of rearrangement and distribution of the travelling webs similar to those shown in FIG. 18(A)
FIG. 19(B) is an explanatory right-hand side elevational view of the upper W-width former.
FIG. 19(C) is an explanatory right-hand side elevational view of the lower W-width former.

In FIG. 19, all the five travelling webs on the right-hand side and the outermost travelling web on the left-hand side are introduced to the lower former 46 through the route (2) of the second rearranging means, and the inner four travelling webs on the left-hand side are introduced directly to the upper former 45. As a result, the travelling webs on the upper former 45 are, as shown in FIG. 19(B), stacked in four layers of single-color printed pages, while the travelling webs on the lower former 46 are, as shown in FIG. 19(C), stacked in six layers with the color printed pages (black ▽ and white ▽) delivered to the under surface of the topmost travelling web and the upper surface of the second uppermost travelling web, respectively.

Figure 20:
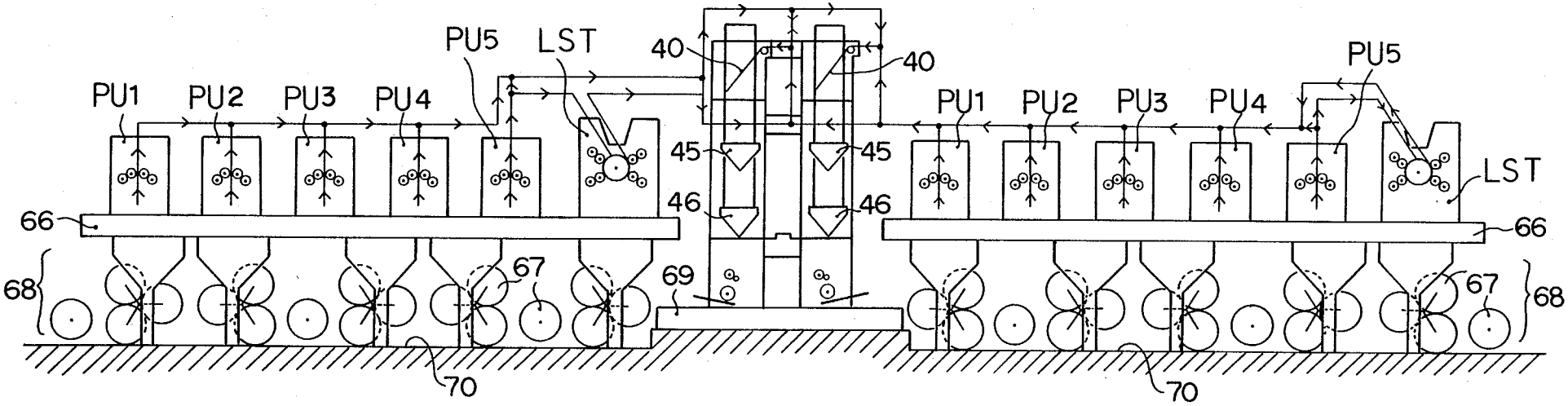
FIG. 20 is a side elevational view of an example of a parallel combination type rotary press apparatus for producing a 40-page newspaper containing a color printed page, the rotary press apparatus consisting of a combination of two rotary presses shown in FIG. 9.

FIG. 20 shows the entire arrangement of a parallel combination type rotary press arrangement in which two rotary presses shown in FIG. 9 are connected to each other for producing a 40-page newspaper containing a color printed page. Feeding mechanisms 68 for travelling webs 67 are disposed under a machine bed 66 for the rotary presses. If a machine bed 69 for the turning-bar-less W-width folding machines according to the present invention is placed on the floor 70 of the feeding mechanisms 68, it is possible to greatly reduce the height of the folding machines and, hence, the space for installation thereof.

Figure 22:
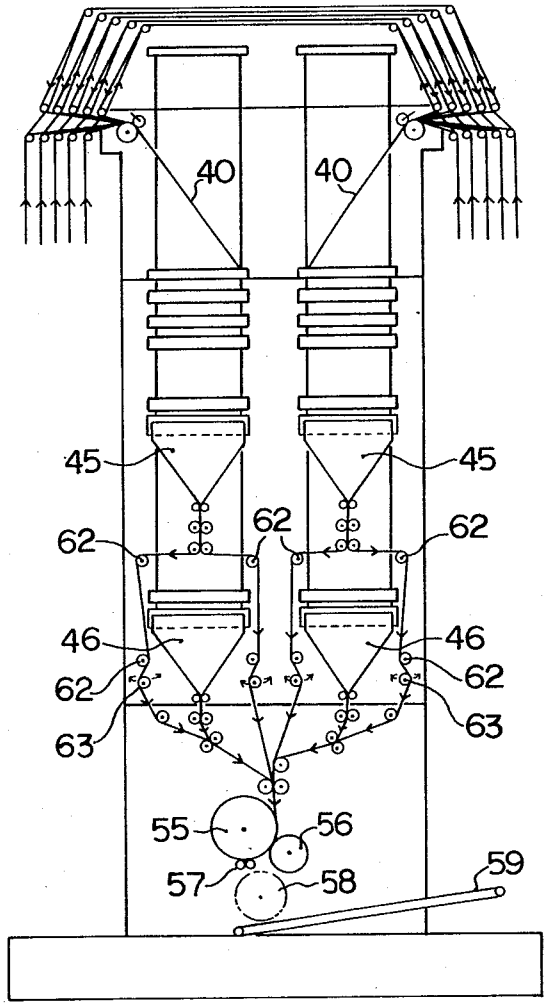
FIG. 22 is a side elevational view of a modification of the two folding machines shown in FIG. 21, which are connected to each other in the opposite direction.
Figure 21:
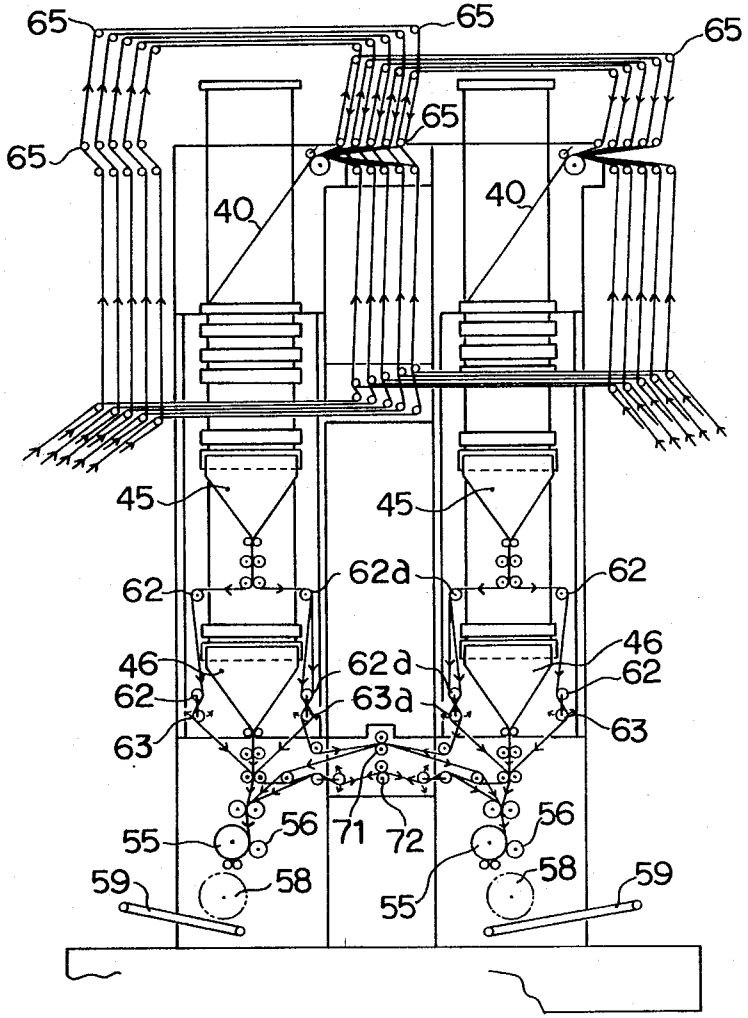
FIG. 21 is an enlarged side elevational view of the two folding machines shown in FIG. 20, which are connected to each other in the same direction.

When two rotary presses are connected, what is important is to arrange the two folding machines adjacently to each other, so that it is possible, as shown in FIG. 21 (W-width formers are placed in the same direction) and FIG. 22 (W-width formers are placed in the opposite directions), to combine all or a part of the ½ W-width travelling webs which are folded by one folding machine with all the ½ W-width travelling webs which are folded by the other folding machine. Accordingly, it is possible to produce a newspaper consisting of, e.g, two sections comprising 40 pages and 20 pages, three sections comprising 40 pages, 20 pages and 20 pages, or two sections comprising respective 40 pages by combining the newspaper of, e.g., one section comprising 40 pages in maximum which are produced by the latter folding machine with the newspapers consisting of, e.g., one section comprising 20 pages, two sections comprising respective 20 pages, or one section comprising 40 pages, respectively, which are produced by the former folding machine.

It goes without saying that although FIGS. 20 to 22 illustrate the examples for producing a newspaper containing a color printed page, the above-described combination is possible in producing a newspaper consisting solely of single-color printed pages.

There are following two kinds of combining means in the parallel combination type folding apparatus shown in FIG. 21:

(1) a second combining means for leading the ¼ W-width travelling webs which have been discharged from the upper former 45 and which have passed through the aforementioned route of the combining means in one folding machine (hereinunder referred to as "the first route of the combining means") through the detour (through the guide rolls 62*a*) close to the other folding machine, through first relay nipping rolls 71 which are provided between the two folding machines, combining these ¼ W-width travelling webs with the ¼ W-width traveling travelling webs discharged from the lower ½ W-width former 46 of the other folding machine, and introducing them together to the cross cutting and folding mechanism on the other folding machine; and (2) a third combining means for introducing the ¼ W-width travelling webs discharged from the lower former 46 of one folding machine to the immediate upstream side of the cross cutting and folding mechanism of the other folding machine through second relay nipping rolls 72 which are provided between the two folding machines, so that the ¼ travelling webs from the one folding machine and those of the other folding machine together are cross cut and folded.

In the embodiments shown in FIGS. 20 and 21, which are the parallel combination type folding apparatus, the two folding machines are provided with the respective cross cutting and folding mechanisms 55, 56 and 57 and the respective delivery mechanisms 58 and 59 so that they may be operated independently of each other. If they are used exclusively for parallel operation, a single set of the above-described mechanism suffices, as shown in FIG. 22.

In this case, a combining means is designed so as to simultaneously combine the detours through which the ¼ W-width travelling webs discharged from the respective upper formers 45 of both folding machines pass on the right and left sides of the respective lower formers 46, namely, four detours in total, with the routes for the ¼ W-width travelling webs discharged from the respective lower W-width formers 46 of both folding machines pass, namely, two routes in total on the immediate upstream side of the single cross cutting and folding mechanism.

The advantages of the present invention will be mentioned hereinunder as compared with the prior art (see FIGS. 1, 2, 3, 4 and 23).

(1) In the prior art, the W-width travelling webs are longitudinally divided into two separately by the respective five drag rolls 25 provided with the respective slitter knives 26, while in the present invention the slitting operation is concentratedly conducted by the single drag roll 41 provided with the slitter knife 42.

(2) The operation of gathering the divided right-hand and left-hand ½ W-width travelling webs is separately conducted in the prior art by the respective turning bar mechanisms 27 provided exclusively for the respective press units PU1 to PU5. In the present invention, the W-width former 40 conducts this gathering operation simultaneously with the slitting operation without using any turning bar, whereby the turning bar mechanism, adjusting rolls, and rail frames, which are required by the turning bar mechanism, are removed from the rotary press. As a result, all inconveniences the above-described elements have brought about are eliminated, thereby preventing any smear on the printed surface, reducing the ratio of spoilage and breakage of paper and, hence, largely enhancing the productivity, increasing in operational speed, facilitating the tension adjustment with respect to all the traveling webs, and promoting automatization and simplification of operation, reduction in man power, simplification of the structure and reduction in cost.

(3) Since the ½ W-width travelling webs discharged from the W-width former 40 are distributed equally or unequally to the upper and lower ½ W-width formers 45 and 46, which are provided on the downstream side of the W-width former 40 at the same position with respect to the lateral direction of the travelling webs, and they are gathered and introduced to the single cross cutting and folding mechanism, production of a newspaper having a great number of pages is achieved smoothly.

(4) Incorporation of color printed pages at a given position within a multiplicity of pages is enabled by providing the means for distributing the ½ travelling webs, the first rearranging means for the W-width travelling webs, and the second and third rearranging means for the ½ W-width travelling webs.

While there has been described what is at present considered to be preferred embodiments of the invention, it will be understood that various modifications may be made thereto, and it is intended that the appended claims cover all such modifications as fall within the true spirit and scope of the invention.

What is claimed is:

1. A turning-bar-less folding mechanism for a W-width rotary press comprising:

a slitting and gathering mechanism for dividing W-width (the width of four pages of a newspaper, hereinunder simply referred to as "W-width") travelling webs into two and gathering the divided travelling webs, said mechanism including a former having an inverted triangular configuration with the base thereof having a length equivalent to the W-width of said travelling webs, a W-width drag roll provided immediately on the upstream side of said former, a slitter knife the edge of which can come into and out of contact with the center of said drag roll, a pair of ½ W-width forming rolls which are provided immediately on the downstream side of said former, and a pair of ½ W-width nipping rolls which are provided on the downstream side of said forming rolls;

a vertical pair of longitudinally folding mechanisms which are provided on the downstream side of said slitting and gathering mechanism and which longitudinally fold ½ W-width travelling webs, said mechanisms including a vertical pair of formers having an inverted triangular configuration with the base thereof having a length equivalent to the ½ W-width of said travelling webs and disposed at the same position with respect to the lateral direction of said travelling webs, ½ W-width drag rolls provided immediately on the respective upstream sides of said formers, a pair of ¼ W-width forming rolls provided immediately on the downstream side of each of said formers, and a pair of ¼ W-width nipping rolls which are provided on the downstream side of each of said ¼ W-width forming rolls;

a conveying means for distributing the ½ W-width travelling webs discharged from said slitting and gathering mechanism equally or unequally to the upper and lower longitudinally folding mechanisms;

a cross cutting and folding mechanism which is provided immediately on the downstream side of said longitudinally folding mechanisms and which cross cuts and folds said ¼ W-width travelling webs, said cross cutting and folding mechanism including a ¼ W-width folding drum, a ¼ W-width serrated drum and a pair of second folding rolls;

a combining means for introducing the ¼ W-width travelling webs discharged from said upper folding mechanism through a detour of the right-hand side or left-hand side of said lower ½ W-width former to the route of the ¼ W-width travelling webs discharged from said lower folding mechanism; and a delivery mechanism provided at the extreme downstream end and including a fan and a conveyor.

2. A turning-bar-less folding mechanism for a W-width rotary press comprising:

a slitting and gathering mechanism for dividing W-width travelling webs into two and gathering the divided travelling webs, said mechanism including a former having an inverted triangular configuration with the base thereof having a length equivalent to the W-width of said travelling webs, a W-width drag roll provided immediately on the upstream side of said former, a slitter knife the edge of which can come into and out of contact with the center of said drag roll, a pair of ½ W-width forming rolls which are provided immediately on the downstream side of said former, and a pair of ½ W-width nipping rolls which are provided on the downstream side of said forming rolls;

a vertical pair of longitudinally folding mechanisms which are provided on the downstream side of said slitting and gathering mechanism and which longitudinally fold ½ W-width travelling webs, said mechanisms including a vertical pair of formers having an inverted triangular configuration with the base thereof having a length equivalent to the ½ W-width of said travelling webs and disposed at the same position with respect to the lateral direction of said travelling webs, ½ W-width drag rolls provided immediately on the respective upstream sides of said formers, a pair of ¼ W-width forming rolls provided immediately on the downstream side of each of said formers, and a pair of ¼ W-width nipping rolls which are provided on the downstream side of each of said ¼ W-width forming rolls;

a conveying means for distributing the ½ W-width travelling webs discharged from said slitting and gathering mechanism equally or unequally to the upper and lower longitudinally folding mechanisms;

a cross cutting and folding mechanism which is provided immediately on the downstream side of said longitudinally folding mechanisms and which cross cuts and folds said ¼ W-width travelling webs, said cross cutting and folding mechanism including a ¼ W-width folding drum, a ¼ W-width serrated drum and a pair of second folding rolls;

a combining means for introducing the $\frac{1}{4}$ W-width travelling webs discharged from said upper folding mechanism through a detour of the right-hand side or left-hand side of said lower $\frac{1}{2}$ W-width former to the route of the $\frac{1}{4}$ W-width travelling webs discharged from said lower folding mechanism;

a delivery mechanism provided at the extreme downstream end and including a fan and a conveyor; and a first color printed page rearranging means for introducing all or a part of said W-width travelling webs from said slitting and folding mechanism to said W-width former from the opposite direction through a space having a width equivalent to the W-width which is formed at the central portion of the route of said conveying means for distributing said $\frac{1}{2}$ W-width travelling webs from said slitting and folding mechanism to said upper and lower longitudinally folding mechanisms, respectively, by shifting said route of said conveying means sideways by a distance corresponding to at least $\frac{1}{2}$ W-width.

3. A turning-bar-less folding mechanism for a W-width rotary press comprising:

a slitting and gathering mechanism for dividing W-width travelling webs into two and gathering the divided travelling webs, said mechanism including a former having an inverted triangular configuration with the base thereof having a length equivalent to the W-width of said travelling webs, a W-width drag roll provided immediately on the upstream side of said former, a slitter knife the edge of which can come into and out of contact with the center of said drag roll, a pair of $\frac{1}{2}$ W-width forming rolls which are provided immediately on the downstream side of said former, and a pair of $\frac{1}{2}$ W-width nipping rolls which are provided on the downstream side of said forming rolls;

a vertical pair of longitudinally folding mechanisms which are provided on the downstream side of said slitting and gathering mechanism and which longitudinally fold $\frac{1}{2}$ W-width travelling webs, said mechanisms including a vertical pair of formers having an inverted triangular configuration with the base thereof having a length equivalent to the $\frac{1}{2}$ W-width of said travelling webs and disposed at the same position with respect to the lateral direction of said travelling webs, $\frac{1}{2}$ W-width drag rolls provided immediately on the respective upstream sides of said formers, a pair of $\frac{1}{4}$ W-width forming rolls provided immediately on the downstream side of each of said formers, and a pair of $\frac{1}{4}$ W-width nipping rolls which are provided on the downstream side of each of said W-width forming rolls;

a conveying means for distributing the $\frac{1}{2}$ W-width travelling webs discharged from said slitting and gathering mechanism equally or unequally to the upper and lower longitudinally folding mechanisms;

a cross cutting and folding mechanism which is provided immediately on the downstream side of said longitudinally folding mechanisms and which cross cuts and folds said $\frac{1}{4}$ W-width travelling webs, said cross cutting and folding mechanism including a $\frac{3}{4}$ W-width folding drum, a $\frac{1}{4}$ W-width serrated drum and a pair of second folding rolls;

a combining means for introducing the $\frac{1}{4}$ W-width travelling webs discharged from said upper folding mechanism through a detour of the right-hand side or left-hand side of said lower $\frac{1}{2}$ W-width former to the route of the $\frac{1}{4}$ W-width travelling webs discharged from said lower folding mechanism;

a delivery mechanism provided at the extreme downstream end and including a fan and a conveyor; and a second color printed page rearranging means for introducing all or a part of the $\frac{1}{2}$ W-width travelling webs on the right-hand or left-hand side discharged from said slitting and folding mechanism, to either or both of said folding mechanisms around said W-width former from the right-hand side or left-hand side.

4. A turning-bar-less folding mechanism for a W-width rotary press comprising:

a slitting and gathering mechanism for dividing W-width travelling webs into two and gathering the divided travelling webs, said mechanism including a former having an inverted triangular configuration with the base thereof having a length equivalent to the W-width of said travelling webs, a W-width drag roll provided immediately on the upstream side of said former, a slitter knife the edge of which can come into and out of contact with the center of said drag roll, a pair of $\frac{1}{2}$ W-width forming rolls which are provided immediately on the downstream side of said former, and a pair of $\frac{1}{2}$ W-width nipping rolls which are provided on the downstream side of said forming rolls;

a vertical pair of longitudinally folding mechanisms which are provided on the downstream side of said slitting and gathering mechanism and which longitudinally fold $\frac{1}{2}$ W-width travelling webs, said mechanisms including a vertical pair of formers having an inverted triangular configuration with the base thereof having a length equivalent to the $\frac{1}{2}$ W-width of said travelling webs and disposed at the same position with respect to the lateral direction of said travelling webs, $\frac{1}{2}$ W-width drag rolls provided immediately on the respective upstream sides of said formers, a pair of $\frac{1}{4}$ W-width forming rolls provided immediately on the downstream side of each of said formers, and a pair of $\frac{1}{4}$ W-width nipping rolls which are provided on the downstream side of each of said $\frac{1}{4}$ W-width forming rolls;

a conveying means for distributing the $\frac{1}{2}$ W-width travelling webs discharged from said slitting and gathering mechanism equally or unequally to the upper and lower longitudinally folding mechanisms;

a cross cutting and folding mechanism which is provided immediately on the downstream side of said longitudinally folding mechanisms and which cross cuts and folds said $\frac{1}{4}$ W-width travelling webs, said cross cutting and folding mechanism including a $\frac{1}{4}$ W-width folding drum, a $\frac{1}{4}$ W-width serrated drum and a pair of second folding rolls;

a combining means for introducing the $\frac{1}{4}$ W-width travelling webs discharged from said upper folding mechanism through a detour of the right-hand side or left-hand side of said lower $\frac{1}{2}$ W-width former to the route of the $\frac{1}{4}$ W-width travelling webs discharged from said lower folding mechanism;

a delivery mechanism provided at the extreme downstream end and including a fan and a conveyor; and a third color printed page rearranging means for introducing all or a part of the $\frac{1}{2}$ W-width travelling webs on the right-hand or left-hand side discharged from said slitting and folding mechanism, to said lower folding mechanism through a detour in front of said upper folding machine.

5. A turning-bar-less folding mechanism for a W-width rotary press comprising:

a slitting and gathering mechanism for dividing W-width travelling webs into two and gathering the divided travelling webs, said mechanism including a former having an inverted triangular configuration with the base thereof having a length equivalent to the W-width of said travelling webs, a W-width drag roll provided immediately on the upstream side of said former, a slitter knife the edge of which can come into and out of contact with the center of said drag roll, a pair of ½ W-width forming rolls which are provided immediately on the downstream side of said former, and a pair of ½ W-width nipping rolls which are provided on the downstream side of said forming rolls;

a vertical pair of longitudinally folding mechanisms which are provided on the downstream side of said slitting and gathering mechanism and which longitudinally fold ½ W-width travelling webs, said mechanisms including a vertical pair of formers having an inverted triangular configuration with the base thereof having a length equivalent to the ½ W-width of said travelling webs and disposed at the same position with respect to the lateral direction of said travelling webs, ½ W-width drag rolls provided immediately on the respective upstream sides of said formers, a pair of ¼ W-width forming rolls provided immediately on the downstream side of each of said formers, and a pair of ¼ W-width nipping rolls which are provided on the downstream side of each of said ¼ W-width forming rolls;

a conveying means for distributing the ½ W-width travelling webs discharged from said slitting and gathering mechanism equally or unequally to the upper and lower longitudinally folding mechanisms;

a cross cutting and folding mechanism which is provided immediately on the downstream side of said longitudinally folding mechanisms and which cross cuts and folds said ¼ W-width travelling webs, said cross cutting and folding mechanism including a ¼ W-width folding drum, a ¼ W-width serrated drum and a pair of second folding rolls;

a combining means for introducing the ¼ W-width travelling webs discharged from said upper folding mechanism through a detour of the right-hand side or left-hand side of said lower ½ W-width former to the route of the ¼ W-width travelling webs discharged from said lower folding mechanism;

a delivery mechanism provided at the extreme downstream end and including a fan and a conveyor; and a first color printed page rearranging means for introducing all or a part of said ½ W-width travelling webs from said slitting and folding mechanism to said W-width former from the opposite direction through a space having a width equivalent to the W-width which is formed at the central portion of the route of said conveying means for distributing said W-width travelling webs from said slitting and folding mechanism to said upper and lower longitudinally folding mechanisms, respectively, by shifting said route of said conveying means sideways by a distance corresponding to at least ½ W-width;

a second color printed page rearranging means for introducing all or a part of the ½ W-width travelling webs on the right-hand or left-hand side discharged from said slitting and folding mechanism, to either or both of said folding mechanisms around said W-width former from the right-hand side or left-hand side; and a third color printed page rearranging means for introducing all or a part of the ½ W-width travelling webs on the right-hand or left-hand side discharged from said slitting and folding mechanism, to said lower folding mechanism through a detour in front of or at the back of said upper folding machine.

6. A turning-bar-less folding mechanism for a W-width rotary press comprising:

a slitting and gathering mechanism for dividing W-width travelling webs into two and gathering the divided travelling webs, said mechanism including a former having an inverted triangular configuration with the base thereof having a length equivalent to the W-width of said travelling webs, a W-width drag roll provided immediately on the upstream side of said former, a slitter knife the edge of which can come into and out of contact with the center of said drag roll, a pair of ½ W-width forming rolls which are provided immediately on the downstream side of said former, and a pair of ½ W-width nipping rolls which are provided on the downstream side of said forming rolls;

a vertical pair of longitudinally folding mechanisms which are provided on the downstream side of said slitting an gathering mechanism and which longitudinally fold ½ W-width travelling webs, said mechanisms including a vertical pair of formers having an inverted triangular configuration with the base thereof having a length equivalent to the ½ W-width of said travelling webs and disposed at the same position with respect to the lateral direction of said travelling webs, ½ W-width drag rolls provided immediately on the respective upstream sides of said formers, a pair of ¼ W-width forming rolls provided immediately on the downstream side of each of said formers, and a pair of ¼ W-width nipping rolls which are provided on the downstream side of each of said ¼ W-width forming rolls;

a conveying means for distributing the ½ W-width travelling webs discharged from said slitting and gathering mechanism equally or unequally to the upper and lower longitudinally folding mechanisms;

a cross cutting and folding mechanism which is provided immediately on the downstream side of said longitudinally folding mechanisms and which cross cuts and folds said ¼ W-width travelling webs, said cross cutting and folding mechanism including a ¼ W-width folding drum, a ¼ W-width serrated drum and a pair of second folding rolls;

a combining means for introducing the ¼ W-width travelling webs discharged from said upper folding mechanism through a detour of the right-hand side or left-hand side of said lower ½ W-width former to the route of the ¼ W-width travelling webs discharged from said lower folding mechanism;

a delivery mechanism provided at the extreme downstream end and including a fan and a conveyor; and a machine bed which is provided on the floor of a feeding mechanism to support all of said mechanisms.

7. A turning-bar-less folding apparatus comprising:

two folding machines each of which includes a slitting and gathering mechanism for dividing W-width travelling webs into two and gathering the divided travelling webs, said mechanism including a former having an inverted triangular configuration with the base thereof having a length equivalent to the W-width of said travelling webs, a W-width drag roll provided immediately on the upstream side of said former, a slitter knife the edge of which can come into and out of contact with the center of said drag roll, a pair of ½ W-width forming rolls which are provided immediately on the downstream side of said former, and a pair of ½ W-width nipping rolls which are provided on the downstream side of said forming rolls;

a vertical pair of longitudinally folding mechanisms which are provided on the downstream side of said slitting and gathering mechanism and which longitudinally fold ½ W-width travelling webs, said mechanisms including a vertical pair of formers having an inverted triangular configuration with the base thereof having a length equivalent to the ½ W-width of said travelling webs and disposed at the same position with respect to the lateral direction of said travelling webs, ½ W-width drag rolls provided immediately on the respective upstream sides of said formers, a pair of ¼ W-width forming rolls provided immediately on the downstream side of each of said formers, and a pair of ¼ W-width nipping rolls which are provided on the downstream side of each of said ¼ W-width forming rolls;

a conveying means for distributing the ½ W-width travelling webs discharged from said slitting and gathering mechanism equally or unequally to the upper and lower longitudinally folding mechanisms;

a cross cutting and folding mechanism which is provided immediately on the downstream side of said longitudinally folding mechanisms and which cross cuts and folds said ¼ W-width travelling webs, said cross cutting and folding mechanism including a ¼ W-width folding drum, a ¼ W-width serrated drum and a pair of second folding rolls;

a combining means for introducing the ¼ W-width travelling webs discharged from said upper folding mechanism through a detour of the right-hand side or left-hand side of said lower ½ W-width former to the route of the ¼ W-width travelling webs discharged from said lower folding mechanism;

a delivery mechanism provided at the extreme downstream end and including a fan and a conveyor; and a second combining means for leading said ¼ W-width travelling webs which have been discharged from said upper folding mechanism on one side and which have passed through a detour which is close to the other folding machine, through first relay nipping rolls and combining said W-width travelling webs with the ¼ W-width traveling travelling webs discharged from said lower folding mechanism of the latter folding machine.

8. A turning-bar-less folding apparatus comprising:

two folding machines each of which includes a slitting and gathering mechanism for dividing W-width travelling webs into two and gathering the divided travelling webs, said mechanism including a former having an inverted triangular configuration with the base thereof having a length equivalent to the W-width of said travelling webs, a W-width drag roll provided immediately on the upstream side of said former, a slitter knife the edge of which can come into and out of contact with the center of said drag roll, a pair of ½ W-width forming rolls which are provided immediately on the downstream side of said former, and a pair of ½ W-width nipping rolls which are provided on the downstream side of said forming rolls, a vertical pair of longitudinally folding mechanisms which are provided on the downstream side of said slitting and gathering mechanism and which longitudinally fold W-width travelling webs, said mechanisms including a vertical pair of formers having an inverted triangular configuration with the base thereof having a length equivalent to the ½ W-width of said travelling webs and disposed at the same position with respect to the lateral direction of said travelling webs, ½ W-width drag rolls provided immediately on the respective upstream sides of said formers, a pair of ¼ W-width forming rolls provided immediately on the downstream side of each of said formers, and a pair of ¼ W-width nipping rolls which are provided on the downstream side of each of said ¼ W-width forming rolls, a conveying means for distributing the ½ W-width travelling webs discharged from said slitting and gathering mechanism equally or unequally to the upper and lower longitudinally folding mechanisms, a cross cutting and folding mechanism which is provided immediately on the downstream side of said longitudinally folding mechanisms and which cross cuts and folds said ¼ W-width travelling webs, said cross cutting and folding mechanism including a ¼ W-width folding drum, a ¼ W-width serrated drum and a pair of second folding rolls, a combining means for introducing the ¼ W-width travelling webs discharged from said upper folding mechanism through a detour of the right-hand side or left-hand side of said lower ½ W-width former to the route of the ¼ W-width travelling webs discharged from said lower folding mechanism, and a delivery mechanism provided at the extreme downstream end and including a fan and a conveyor; and a third combining means for introducing the ½ W-width travelling webs discharged from said lower folding mechanism of one folding machine to the immediate upstream side of said cross cutting and folding mechanism of the other folding machine through second relay nipping rolls.

9. A turning-bar-less folding apparatus comprising:

two folding machines each of which includes a slitting and gathering mechanism for dividing W-width travelling webs into two and gathering the divided travelling webs, said mechanism including a former having an inverted triangular configuration with the base thereof having a length equivalent to the W-width of said travelling webs, a W-width drag roll provided immediately on the upstream side of said former, a slitter knife the edge of which can come into and out of contact with the center of said drag roll, a pair of ½ W-width forming rolls which are provided immediately on the downstream side of said former, and a pair of ½

W-width nipping rolls which are provided on the downstream side of said forming rolls, a vertical pair of longitudinally folding mechanisms which are provided on the downstream side of said slitting and gathering mechanism and which longitudinally fold $\frac{1}{2}$ W-width travelling webs, said mechanisms including a vertical pair of formers having an inverted triangular configuration with the base thereof having a length equivalent to the $\frac{1}{2}$ W-width of said travelling webs and disposed at the same position with respect to the lateral direction of said travelling webs, $\frac{1}{2}$ W-width drag rolls provided immediately on the respective upstream sides of said formers, a pair of $\frac{1}{4}$ W-width forming rolls provided immediately on the downstream side of each of said formers, and a pair of $\frac{1}{4}$ W-width nipping rolls which are provided on the downstream side of each of said $\frac{1}{4}$ W-width forming rolls, and a conveying means for distributing the $\frac{1}{2}$ W-width travelling webs discharged from said slitting and gathering mechanism equally or unequally to the upper and lower longitudinally folding mechanisms;

a cross cutting and folding mechanism which is provided at an intermediate portion immediately on the downstream side of said lower longitudinally folding mechanisms of said two folding machines, and which cross cuts and folds said $\frac{1}{4}$ W-width travelling webs, said cross cutting and folding mechanism including a $\frac{1}{4}$ W-width folding drum, a $\frac{1}{4}$ W-width serrated drum and a pair of second folding rolls;

a delivery mechanism provided at the extreme downstream end and including a fan and a conveyor; and a combining means for simultaneously combining the four detours through which the $\frac{1}{4}$ W-width travelling webs discharged from the respective upper folding mechanisms of both folding machines pass on the right and left sides of the respective lower $\frac{1}{2}$ W-width formers, with the two routes for the $\frac{1}{4}$ W-width travelling webs discharged from the respective lower folding mechanisms of both folding machines on the immediate upstream side of said cross cutting and folding mechanism.

10. A folding apparatus according to any of claims 7, 8 and 9, wherein said W-width formers are disposed in the same direction.

11. A folding apparatus according to any of claims 7, 8 and 9, wherein said W-width formers are disposed in the opposite direction.

* * * * *